US010441856B2

(12) United States Patent
Rice et al.

(10) Patent No.: US 10,441,856 B2
(45) Date of Patent: Oct. 15, 2019

(54) GOLF CLUB HEAD

(71) Applicant: Callaway Golf Company, Carlsbad, CA (US)

(72) Inventors: Bradley C. Rice, Carlsbad, CA (US); William C. Watson, Temecula, CA (US); Patrick Dawson, San Diego, CA (US); Irina Ivanova, San Marcos, CA (US); Brandon D. DeMille, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

(21) Appl. No.: 16/284,097

(22) Filed: Feb. 25, 2019

(65) Prior Publication Data

US 2019/0201755 A1 Jul. 4, 2019

Related U.S. Application Data

(63) Continuation of application No. 16/031,491, filed on Jul. 10, 2018, now Pat. No. 10,213,664, which is a (Continued)

(51) Int. Cl.
*A63B 53/04* (2015.01)
*A63B 60/54* (2015.01)

(52) U.S. Cl.
CPC ..... *A63B 53/0466* (2013.01); *A63B 53/04* (2013.01); *A63B 60/54* (2015.10); (Continued)

(58) Field of Classification Search
USPC ..... 473/324–350
See application file for complete search history.

(56) References Cited

U.S. PATENT DOCUMENTS 1,705,997 A * 3/1929 Quynn ..... A63B 53/04 473/329
1,835,718 A * 12/1931 Morton ..... A63B 53/04 473/328

(Continued)

FOREIGN PATENT DOCUMENTS

JP 06190088 A * 7/1994
JP 07299165 A * 11/1995 ..... A63B 53/04

(Continued)

*Primary Examiner* — Alvin A Hunter
(74) *Attorney, Agent, or Firm* — Rebecca Hanovice; Michael Catania; Sonia Lari

(57) ABSTRACT

A golf club providing improved golf ball launch conditions is disclosed herein. The golf club includes a face component and a sole comprising an elongated recess disposed proximate the face component. The elongated recess preferably is tube shaped, and preferably has an opening with a smaller width than an innermost surface of the elongated recess. The elongated recess may be a separate piece that is permanently affixed within an opening in the sole. Some embodiments of the golf club also comprise a cover affixed to the sole and at least partially covering the opening of the elongated recess, while other embodiments comprise a filler material disposed within the elongated recess or between the elongated recess and an internal surface of the face.

15 Claims, 17 Drawing Sheets

Related U.S. Application Data continuation of application No. 15/722,631, filed on Oct. 2, 2017, now Pat. No. 10,016,664, which is a continuation of application No. 15/290,333, filed on Oct. 11, 2016, now Pat. No. 9,776,057, which is a continuation of application No. 14/547,979, filed on Nov. 19, 2014, now Pat. No. 9,468,819, which is a continuation of application No. 13/656,271, filed on Oct. 19, 2012, now Pat. No. 8,956,242, which is a continuation-in-part of application No. 13/591,111, filed on Aug. 21, 2012, now Pat. No. 8,858,360, which is a continuation-in-part of application No. 13/555,406, filed on Jul. 23, 2012, now Pat. No. 8,403,771.

(60) Provisional application No. 61/578,789, filed on Dec. 21, 2011.

(52) U.S. Cl.
CPC ..... *A63B 2053/0408* (2013.01); *A63B 2053/0433* (2013.01); *A63B 2209/00* (2013.01); *Y10T 29/49863* (2015.01)

(56) References Cited

U.S. PATENT DOCUMENTS 1,854,548 A * 4/1932 Hunt ..... A63B 53/04 473/329
3,061,310 A * 10/1962 Giza ..... A63B 53/0487 473/329
3,679,207 A * 7/1972 Florian ..... A63B 53/007 473/292
3,680,868 A * 8/1972 Jacob ..... A63B 53/0487 473/328
3,961,796 A * 6/1976 Thompson ..... A63B 53/04 473/328
4,319,752 A * 3/1982 Thompson ..... A63B 53/04 473/328
4,398,965 A * 8/1983 Campau ..... A63B 53/04 148/522
4,930,783 A * 6/1990 Antonious ..... A63B 53/04 473/242
5,205,560 A * 4/1993 Hoshi ..... A63B 53/04 473/345
5,213,328 A * 5/1993 Long ..... A63B 53/04 473/346
5,316,305 A * 5/1994 McCabe ..... A63B 53/04 473/332
5,437,456 A * 8/1995 Schmidt ..... A63B 53/04 473/291
5,472,203 A * 12/1995 Schmidt ..... A63B 53/04 473/350
5,492,327 A * 2/1996 Biafore, Jr. ..... A63B 53/04 473/332
5,603,668 A * 2/1997 Antonious ..... A63B 53/04 473/328
5,735,754 A * 4/1998 Antonious ..... A63B 53/04 473/328
5,851,160 A * 12/1998 Rugge ..... A63B 53/04 473/349
6,086,485 A * 7/2000 Hamada ..... A63B 53/04 473/329
6,123,627 A * 9/2000 Antonious ..... A63B 53/04 473/327
6,344,001 B1 * 2/2002 Hamada ..... A63B 53/04 473/329
D482,090 S * 11/2003 Burrows ..... D21/752
D482,420 S * 11/2003 Burrows ..... D21/752
D484,208 S * 12/2003 Burrows ..... D21/752
6,773,359 B1 * 8/2004 Lee ..... A63B 53/0466 473/327
D501,036 S * 1/2005 Burrows ..... D21/752
6,887,165 B2 * 5/2005 Tsurumaki ..... A63B 53/0466 473/344
6,921,343 B2 * 7/2005 Solheim ..... A63B 53/04 473/329
6,991,560 B2 * 1/2006 Tseng ..... A63B 53/0466 473/332
7,059,973 B2 * 6/2006 Erickson ..... A63B 53/0466 473/332
7,211,006 B2 * 5/2007 Chang ..... A63B 53/04 473/329
7,281,988 B2 * 10/2007 Hou ..... A63B 53/0466 473/326
7,294,064 B2 * 11/2007 Tsurumaki ..... A63B 53/0466 473/329
7,393,286 B1 * 7/2008 Renegar ..... A63B 53/047 473/328
7,396,293 B2 * 7/2008 Soracco ..... A63B 53/0466 473/329
7,500,924 B2 * 3/2009 Yokota ..... A63B 53/0466 473/332
7,530,901 B2 * 5/2009 Imamoto ..... A63B 53/0466 473/334
7,549,933 B2 * 6/2009 Kumamoto ..... A63B 53/0466 473/329
7,572,193 B2 * 8/2009 Yokota ..... A63B 53/0466 473/328
7,582,024 B2 * 9/2009 Shear ..... A63B 53/0466 473/329
7,857,711 B2 * 12/2010 Shear ..... A63B 53/0466 473/329
7,867,105 B2 * 1/2011 Moon ..... A63B 53/0475 473/314
7,988,565 B2 * 8/2011 Abe ..... A63B 53/0466 473/328
8,016,694 B2 * 9/2011 Llewellyn ..... A63B 53/0466 473/334
8,235,841 B2 * 8/2012 Stites ..... A63B 53/04 473/328
8,235,844 B2 * 8/2012 Albertsen ..... A63B 53/0466 473/345
8,241,143 B2 * 8/2012 Albertsen ..... A63B 53/0466 473/345
8,241,144 B2 * 8/2012 Albertsen ..... A63B 53/0466 473/345
8,403,771 B1 * 3/2013 Rice ..... A63B 53/04 473/328
8,430,763 B2 * 4/2013 Beach ..... A63B 53/0466 473/307
8,435,134 B2 * 5/2013 Tang ..... A63B 53/04 473/329
8,444,504 B2 * 5/2013 Chao ..... A63B 53/0466 473/329
8,529,368 B2 * 9/2013 Rice ..... A63B 53/04 473/329
8,696,491 B1 * 4/2014 Myers ..... A63B 53/0466 473/334
8,747,250 B2 * 6/2014 Chao ..... A63B 53/0466 473/329
8,827,831 B2 * 9/2014 Burnett ..... A63B 53/0466 473/329
8,834,289 B2 * 9/2014 de la Cruz ..... A63B 53/0466 473/329
8,834,290 B2 * 9/2014 Bezilla ..... A63B 53/0466 473/329
8,858,360 B2 * 10/2014 Rice ..... A63B 53/04 473/329
8,956,242 B2 * 2/2015 Rice ..... A63B 53/0466 473/329
8,961,335 B2 * 2/2015 Sugimoto ..... A63B 53/0466 473/332
9,011,265 B2 * 4/2015 Stites ..... A63B 53/0466 473/327
9,089,747 B2 * 7/2015 Boyd ..... A63B 53/0466
9,211,448 B2 * 12/2015 Bezilla ..... A63B 53/06
9,409,067 B2 * 8/2016 de la Cruz ..... A63B 53/0466

(56) References Cited

U.S. PATENT DOCUMENTS

| | | | | |
|---|---|---|---|---|
| 9,468,819 | B2 * | 10/2016 | Rice | A63B 53/0466 |
| 9,498,688 | B2 * | 11/2016 | Galvan | A63B 60/00 |
| 9,636,559 | B2 * | 5/2017 | de la Cruz | A63B 60/00 |
| 9,675,850 | B2 * | 6/2017 | Bennett | A63B 60/54 |
| 9,700,765 | B2 * | 7/2017 | Frame | A63B 53/0466 |
| 9,776,057 | B2 * | 10/2017 | Rice | A63B 53/0466 |
| 10,039,961 | B2 * | 8/2018 | Golden | A63B 53/0466 |
| 10,076,689 | B2 * | 9/2018 | de la Cruz | A63B 57/00 |
| 10,213,664 | B2 * | 2/2019 | Rice | A63B 53/0466 |
| 2002/0183134 | A1 * | 12/2002 | Allen | A63B 53/04 473/329 |
| 2004/0121852 | A1 * | 6/2004 | Tsurumaki | A63B 53/0466 473/344 |
| 2004/0192463 | A1 * | 9/2004 | Tsurumaki | A63B 53/0466 473/329 |
| 2007/0021234 | A1 * | 1/2007 | Tsurumaki | A63B 53/0466 473/329 |
| 2007/0026961 | A1 * | 2/2007 | Hou | A63B 53/0466 473/329 |
| 2007/0117648 | A1 * | 5/2007 | Yokota | A63B 53/0466 473/328 |
| 2011/0151997 | A1 * | 6/2011 | Shear | A63B 53/0466 473/329 |
| 2011/0218053 | A1 * | 9/2011 | Tang | A63B 53/04 473/349 |
| 2012/0142447 | A1 * | 6/2012 | Boyd | A63B 53/0466 473/329 |
| 2012/0196701 | A1 * | 8/2012 | Stites | A63B 53/0466 473/345 |

FOREIGN PATENT DOCUMENTS

| | | | | |
|---|---|---|---|---|
| JP | 2002320691 | A * | 11/2002 | |
| JP | 2004174224 | A * | 6/2004 | A63B 3/0466 |
| JP | 2004313762 | A * | 11/2004 | |
| JP | 2004351054 | A * | 12/2004 | |
| JP | 2004351173 | A * | 12/2004 | |
| JP | 2005118526 | A * | 5/2005 | |
| JP | 2007275253 | A * | 10/2007 | A63B 53/0466 |
| JP | 2010252964 | A * | 11/2010 | |
| JP | 2010279847 | A * | 12/2010 | |
| JP | 2011010722 | A * | 1/2011 | |

* cited by examiner

GOLF CLUB HEAD

CROSS REFERENCES TO RELATED APPLICATIONS

The present application is a continuation of U.S. patent application Ser. No. 16/031,491, filed on Jul. 10, 2018, and issued on Feb. 26, 2019, as U.S. Pat. No. 10,213,664, which is a continuation of U.S. patent application Ser. No. 15/722,631, filed on Oct. 2, 2017, and issued on Jul. 10, 2018, as U.S. Pat. No. 10,016,664, which is a continuation of U.S. patent application Ser. No. 15/290,333, filed on Oct. 11, 2016, and issued on Oct. 3, 2017, as U.S. Pat. No. 9,776,057, which is a continuation of U.S. patent application Ser. No. 14/547,979, filed on Nov. 19, 2014, and issued on Oct. 18, 2016, as U.S. Pat. No. 9,468,819, which is a continuation of U.S. patent application Ser. No. 13/656,271, filed on Oct. 19, 2012, and issued on Feb. 17, 2015, as U.S. Pat. No. 8,956,242, which is a continuation-in-part of U.S. patent application Ser. No. 13/591,111, filed on Aug. 21, 2012, and issued on Oct. 14, 2014, as U.S. Pat. No. 8,858,360, which is a continuation-in-part of U.S. patent application Ser. No. 13/555,406, filed on Jul. 23, 2012, and issued on Mar. 26, 2013, as U.S. Pat. No. 8,403,771, which claims priority to U.S. Provisional Patent Application No. 61/578,789, filed on Dec. 21, 2011, the disclosure of each of which is hereby incorporated by reference in its entirety herein.

STATEMENT REGARDING FEDERALLY SPONSORED RESEARCH OR DEVELOPMENT

Not Applicable

BACKGROUND OF THE INVENTION

Field of the Invention

The present invention relates to a golf club head having a flexible face designed to improve golf ball launch conditions. The flexibility of the face is enhanced through the inclusion of an elongated recess in the sole of the golf club head.

Description of the Related Art

Traditionally, wood-type and hybrid-type golf club heads are manufactured by welding a face plate or a formed or cast face cup to a body made of one or more pieces. The face causes a golf ball striking the face to launch away from the golf club head. Golf clubs that are currently available on the market, however, do not provide optimized flexibility for impact with golf balls without impacting other factors involved in hitting a golf ball.

For example, several golf clubs currently on the market include sole features proximate the face that are intended to improve golf ball launch conditions. These sole features are slots or grooves having parallel side walls, as shown in FIG. 1, or side walls that slope away from each other as they approach the ground plane, as shown in FIG. 2. In both of these examples, the width of the bottom, innermost part of the groove (x1) is less than or equal to the width of the top, outermost part of the groove (x2). These groove structures typically are selected for ease of manufacture, but they do not provide optimized ball launch conditions. Furthermore, these groove structures can interfere with a golfer's swing because the large discontinuity in their openings causes the back edge of the groove to catch the turf during downswing and at impact.

Another fundamental problem with these groove structures is the fact that the groove opening (x2) drives the design of the groove. If a larger inner surface (x1) is required to improve launch performance, then the groove opening (x2) must also increase, thus impacting the visual appearance of the sole and increasing the likelihood of unwanted turf interaction during play. Therefore, there is a need for a golf club construction that provides improved golf ball launch conditions without also creating unwanted turf interactions.

BRIEF SUMMARY OF THE INVENTION

The present invention is directed to golf club body features that optimize launch conditions of a golf ball impacted on the face of a golf club head while simultaneously reducing interference created by other factors, including turf interaction.

One aspect of the present invention is a golf club head comprising a face comprising a first inner surface that faces an interior cavity of the golf club head, a sole comprising an elongated recess disposed proximate the face, and a first filler material, wherein the elongated recess comprises an opening and a second inner surface that faces the interior cavity, and wherein the first filler material is disposed between the first inner surface and the second inner surface. In some embodiments, the golf club head may further comprise a second filler material that may be disposed within the elongated recess. In some further embodiments, the first filler material and the second filler material may be composed of different materials. The first filler material may be a polymer. In some embodiments, the first filler material may be compressed between the first inner surface and the second inner surface. In other embodiments, the golf club head may further comprise a cover, which may be affixed to the sole and partially cover the opening. In a further embodiment, the sole may comprise a shallow recess sized to receive the cover such that the cover is flush with the sole when the cover is disposed within the shallow recess.

Another aspect of the present invention is a golf club head comprising a face component, a sole comprising an elongated opening proximate the face component, and a groove insert sized to fit within the elongated opening, wherein the groove insert comprises a tube-shaped portion, two end portions, an innermost surface, and a groove opening, wherein the end portions of the groove insert are parallel with and permanently affixed to the sole at one or more edges of the elongated opening. In some embodiments, the innermost surface may have a first width, the groove opening may have a second width, and the first width may be greater than the second width. In other embodiments, the groove insert may be composed of a first material, such as a polymeric material, and the sole may be composed of a second, different material, such as a metal alloy. In still other embodiments, the groove insert may comprise two overlapping prongs. In one embodiment, the golf club head may further comprise a cover, which may be affixed to the sole and partially cover the opening. In a further embodiment, the sole may comprise a shallow recess sized to receive the cover such that the cover is flush with the sole when the cover is disposed within the shallow recess. In a different embodiment, the golf club head may further comprise a filler material disposed within an interior cavity of the golf club head between an inner surface of the face and the groove insert. In a further embodiment, the filler material may be compressed between the inner surface of the face and the groove insert.

Yet another aspect of the present invention is a method of manufacturing a golf club head comprising providing a face cup, providing a body having a crown, a sole, a heel, a toe, and a cutout portion, the cutout portion having a first width, providing a groove insert comprising a second width that is smaller than the first width, an innermost surface, and an opening, disposing the groove insert within the cutout portion, pressing the face cup against the body such that the groove insert is trapped between the cutout portion and the face cup and the cutout portion is compressed so that it has a width equivalent to that of the second width, welding the face cup to the body, permanently affixing the groove insert to at least one surface of the cutout portion and at least one surface of the face cup, and releasing the face cup and the body from compression. In some embodiments, the groove insert may be composed of a polymeric material, and the step of permanently affixing the groove insert to at least one surface of the cutout portion and at least one surface of the face cup may be achieved by bonding.

Another aspect of the present invention is a golf club head comprising a face cup, a body comprising a crown, a sole, a heel, and a toe, and a groove insert, wherein at least one of the sole, crown, heel, and toe comprises a first opening sized to receive the groove insert, and wherein the groove insert is disposed within the first opening in a preloaded state. In a further embodiment, the groove insert may be composed of a polymeric material, and each of the face cup and the body may be composed of a metal alloy material.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
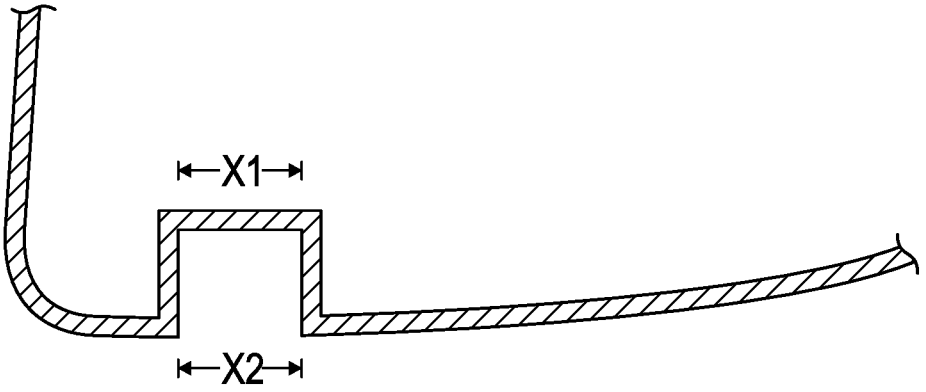
FIG. 1 (Prior Art)
FIG. 1 is a cross sectional view of a prior art golf club having a first sole groove configuration
Figure 2:
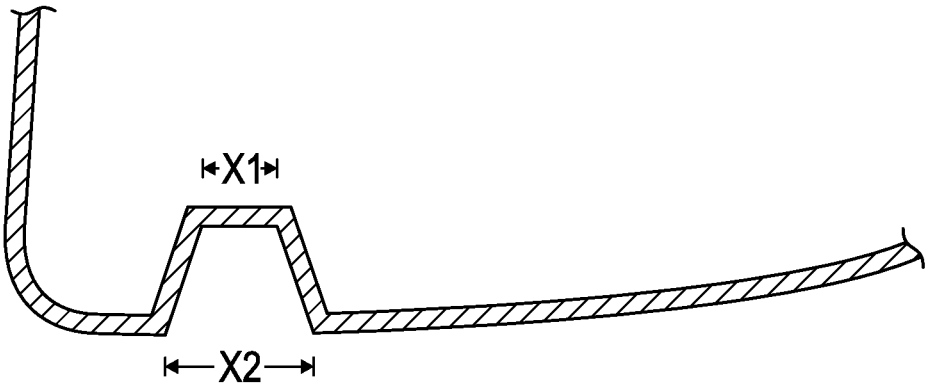
FIG. 2 (Prior Art)
FIG. 2 is a cross sectional view of a prior art golf club having a second sole groove configuration.
Figure 3:
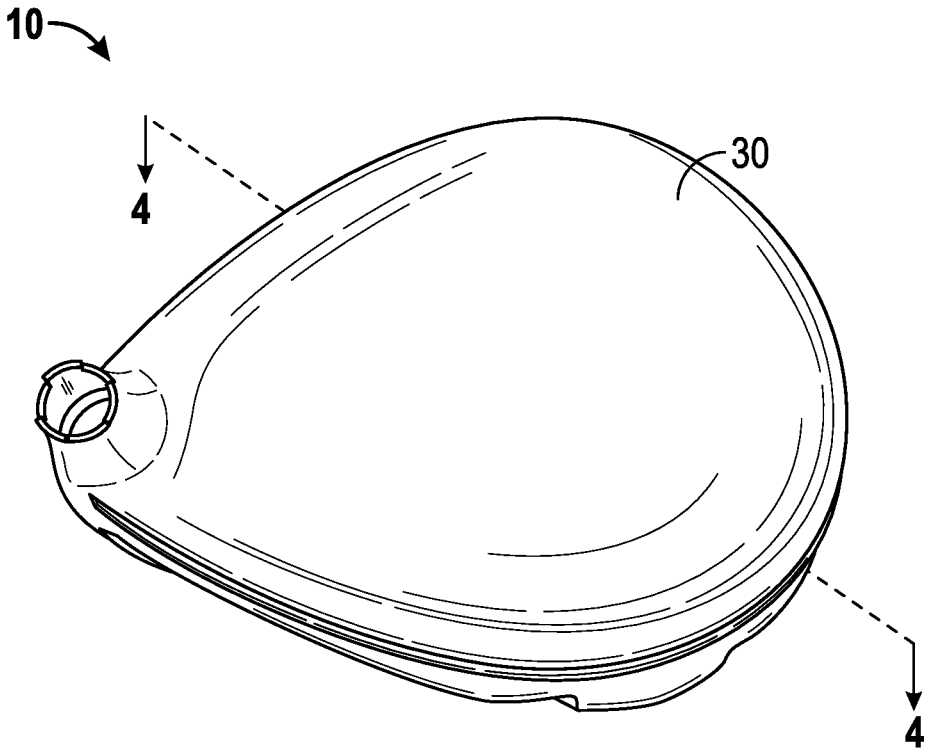
FIG. 3 is a top, perspective view of a first embodiment of the present invention.
Figure 4:
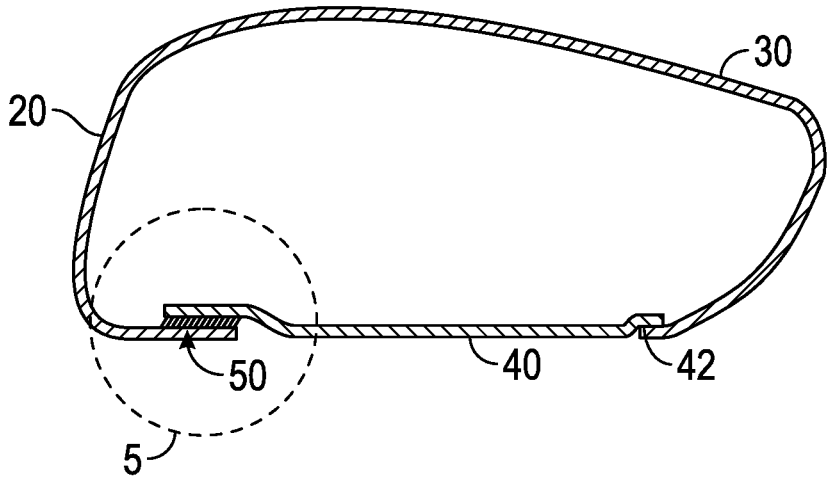
FIG. 4 is a cross-sectional view of the embodiment shown in FIG. 3 along lines 4-4.
Figure 5:
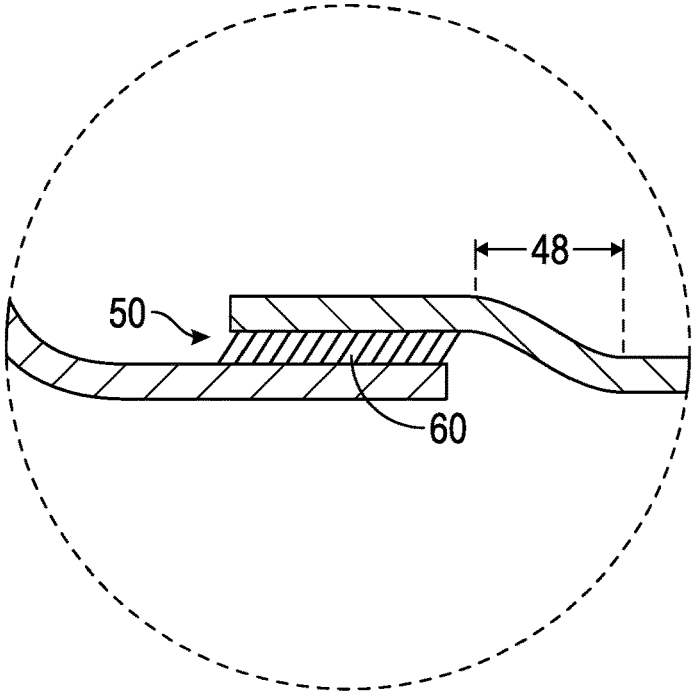
FIG. 5 is a close-up view of the region circled in FIG. 4.
Figure 6:
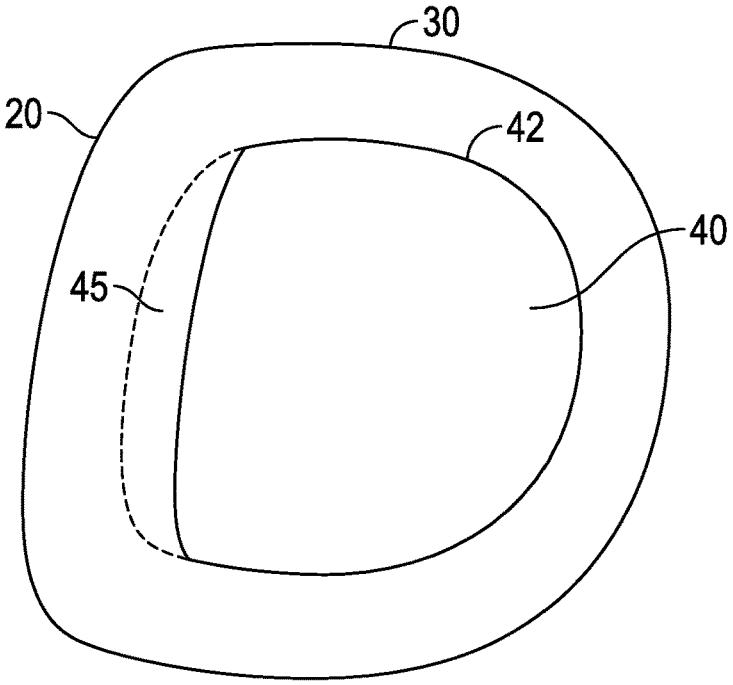
FIG. 6 is a sole, plan view of the embodiment shown in FIG. 3.
Figure 7:
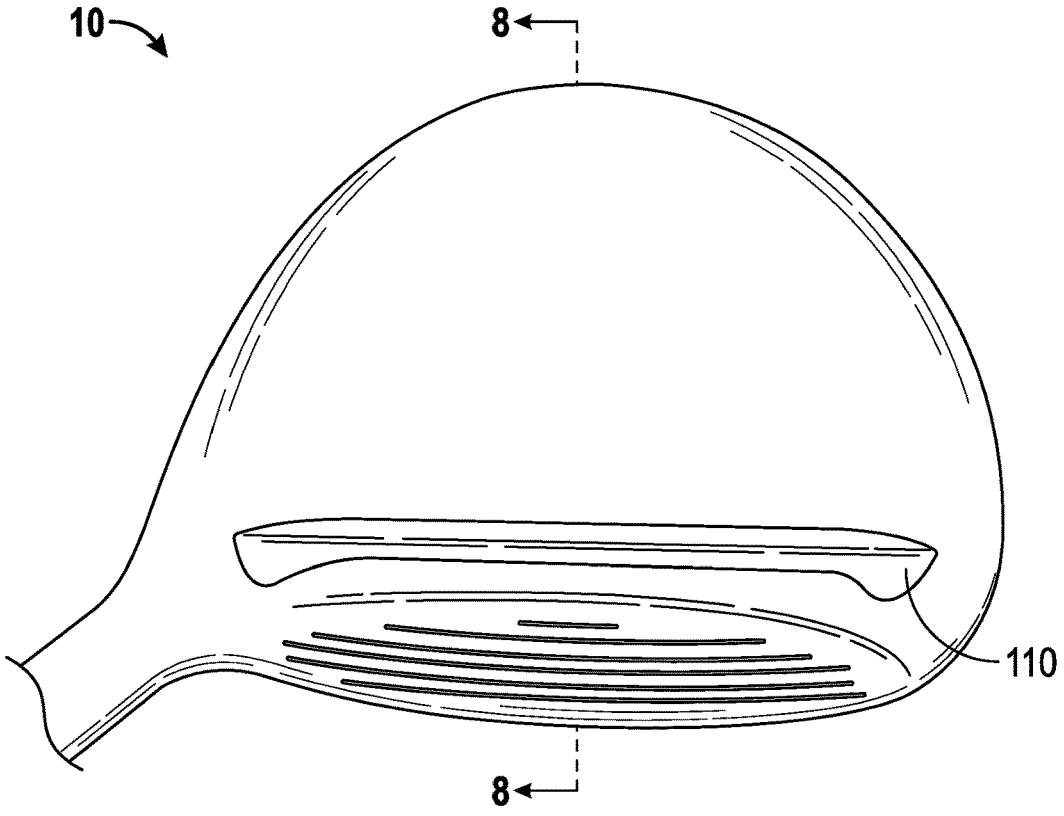
FIG. 7 is a sole, perspective view of a second embodiment of the present invention.
Figure 8:
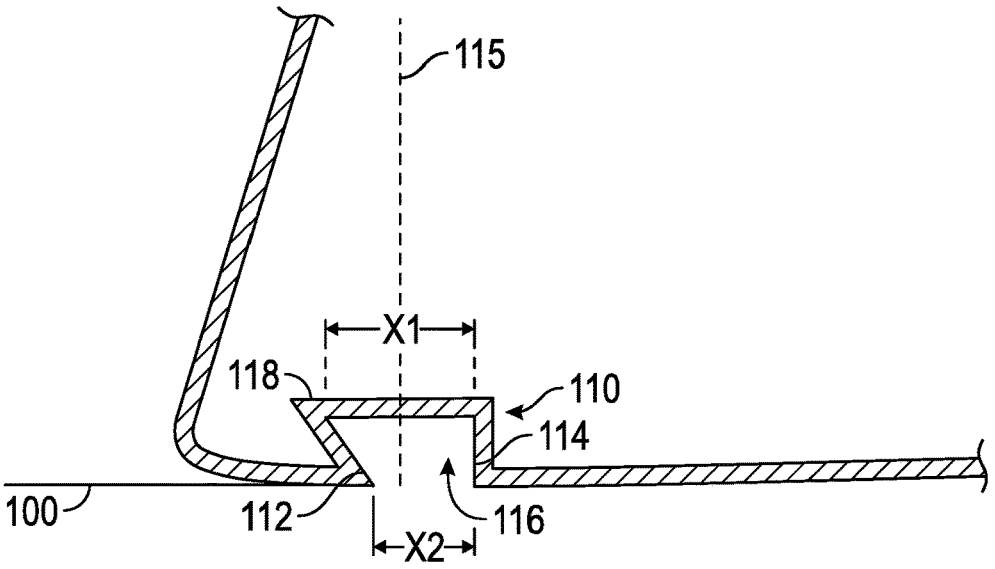
FIG. 8 is a cross-sectional view of the embodiment shown in FIG. 7 along lines 8-8.
Figure 9:
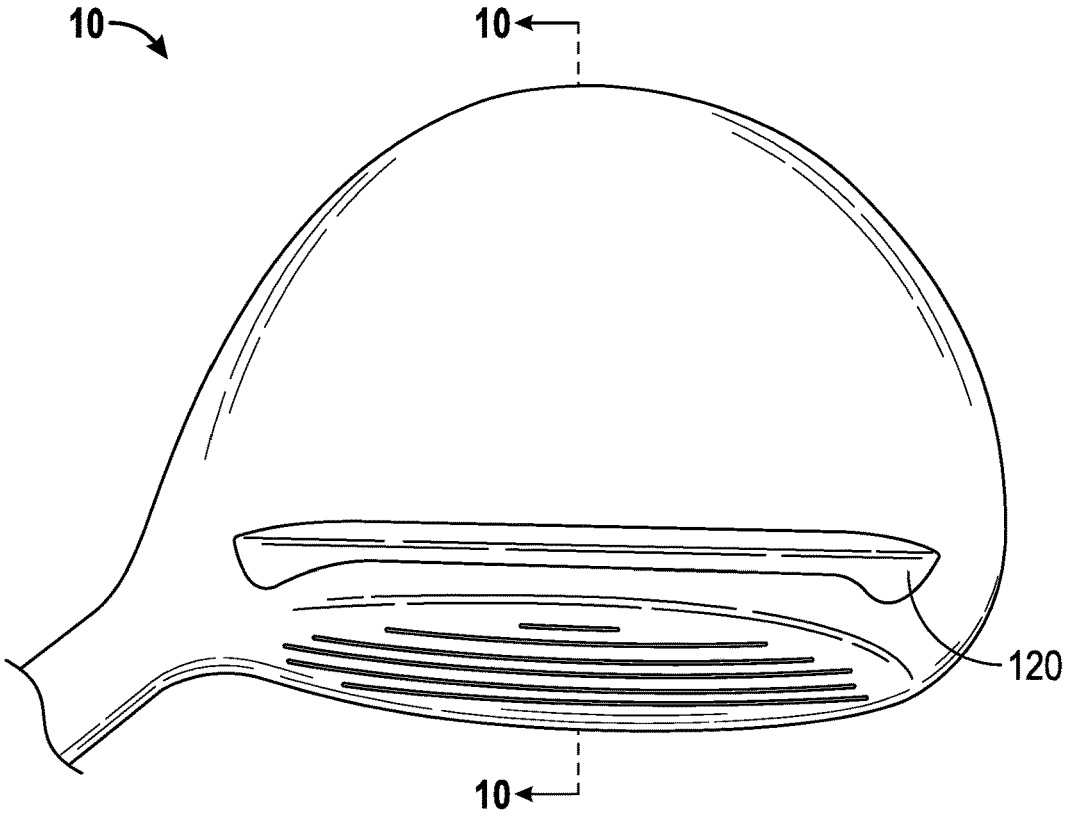
FIG. 9 is a sole, perspective view of a third embodiment of the present invention.
Figure 10:
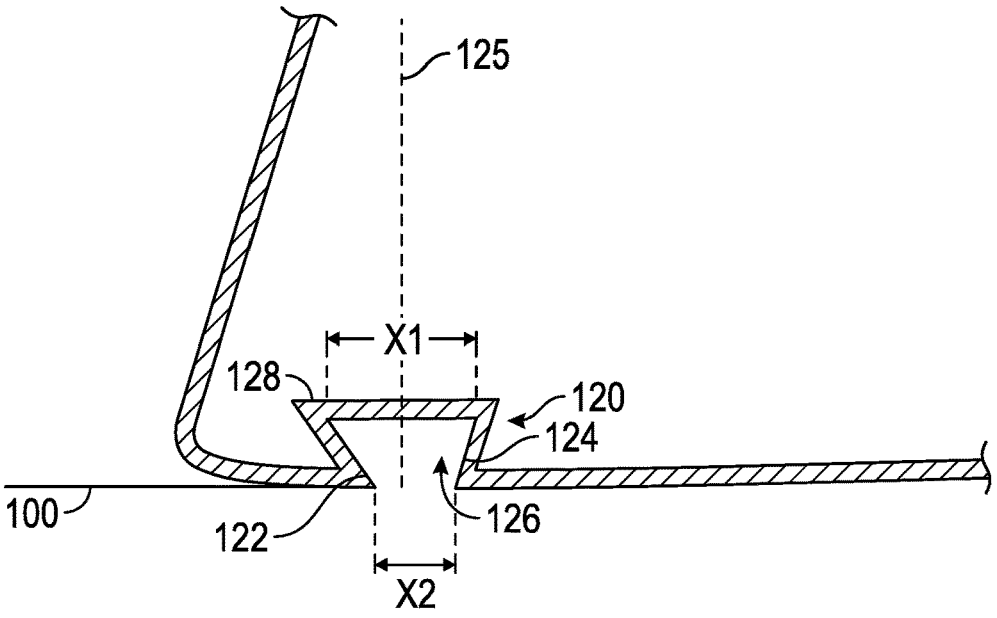
FIG. 10 is a cross-sectional view of the embodiment shown in FIG. 9 along lines 10-10.

The present invention is generally directed to a golf club head with an improved structure designed to reduce energy loss during impact of a golf club head with a golf ball, optimize and balance ball speed robustness, launch angle, and backspin, and reduce turf interaction by minimizing sole discontinuity.

Sole Lap Joint

A first embodiment of the present invention, shown in FIGS. 3-6, comprises a golf club head 10 with a face component 20, a body 30, and a sole plate 40 affixed to the face component with a bonded lap joint 50, which permits the golf club face 20 to flex in an optimized way upon impact with a golf ball. The back part of the sole plate 40 is preferably welded to the body 30 to form a seam 42, and the bonded lap joint 50 preferably comprises a compliant adhesive or sealant 60. The area of the sole plate 40 proximate the lap joint 50 preferably includes an overlap portion 45, which overlaps at least part of the face component 20, preferably on an inside surface of the face component 20. The sole plate 40 also preferably includes a reveal dimension 48 representing a visible recessed area proximate the overlap portion 45. The reveal dimension 48 preferably is small so as to avoid unwanted turf interaction during play.

The face component 20 of the golf club head 10 of the first embodiment preferably is integrally formed with the body 30 for the sake of efficiency during manufacturing, such that a hole is left in the sole of the head 10. This hole is then covered with the sole plate 40, which can be cast, formed, rolled or cut from a metal material. This configuration lowers the overall center of gravity (CG) of the club head 10, particularly if the sole plate 40 is formed of a high density material, prevents the CG from moving forward as far as it would if there were a slot or gap between the face 20 and the sole plate 40, and permits the use of cast 17-4 steel in construction of the head 10, which reduces the manufacturing cost of the head 10 when compared to the use of expensive metals like titanium alloy. The head 10 shown in the first embodiment also does not have an exposed cavity in its sole, which prevents the club head 10 from collecting debris or dirt during use.

Modified Groove

Other embodiments of the present invention are directed to elongated recesses, also referred to herein as grooves, that optimize launch conditions without creating unwanted turf interactions. This is accomplished by de-coupling the groove's shape from its exit geometry size and shape, while at the same time allowing for ease of manufacture, visually appealing aesthetics, and increased performance metrics. As shown in each of the following embodiments, unwanted sole discontinuity, and the resulting turf interaction, is minimized by narrowing the surface opening of the groove. These grooves are also designed to increase the resulting ball speed of a golf ball struck by a head incorporating the grooves without negatively impacting other factors that affect striking distance, including launch angle and backspin.

For example, the sole grooves 110, 120 included in the second and third embodiments of the present invention, illustrated in FIGS. 7-8 and 9-10 respectively, have trapezoidal configurations, each with an opening 116, 126 having an axis 115, 125 that is substantially perpendicular to the ground plane 100, and a width (x2) that is smaller than the width (x1) of the innermost surface 118, 128 of the groove 110, 120. The second embodiment has one negative draft wall 112 and another wall 114 that is approximately perpendicular to the ground plane 100, while the third embodiment has two negative draft walls 122, 124, creating a smaller opening than the one created by the structure of the second embodiment. These sole grooves 110, 120 can be created using casting undercutting methods that are well known in the art.

Figure 11:
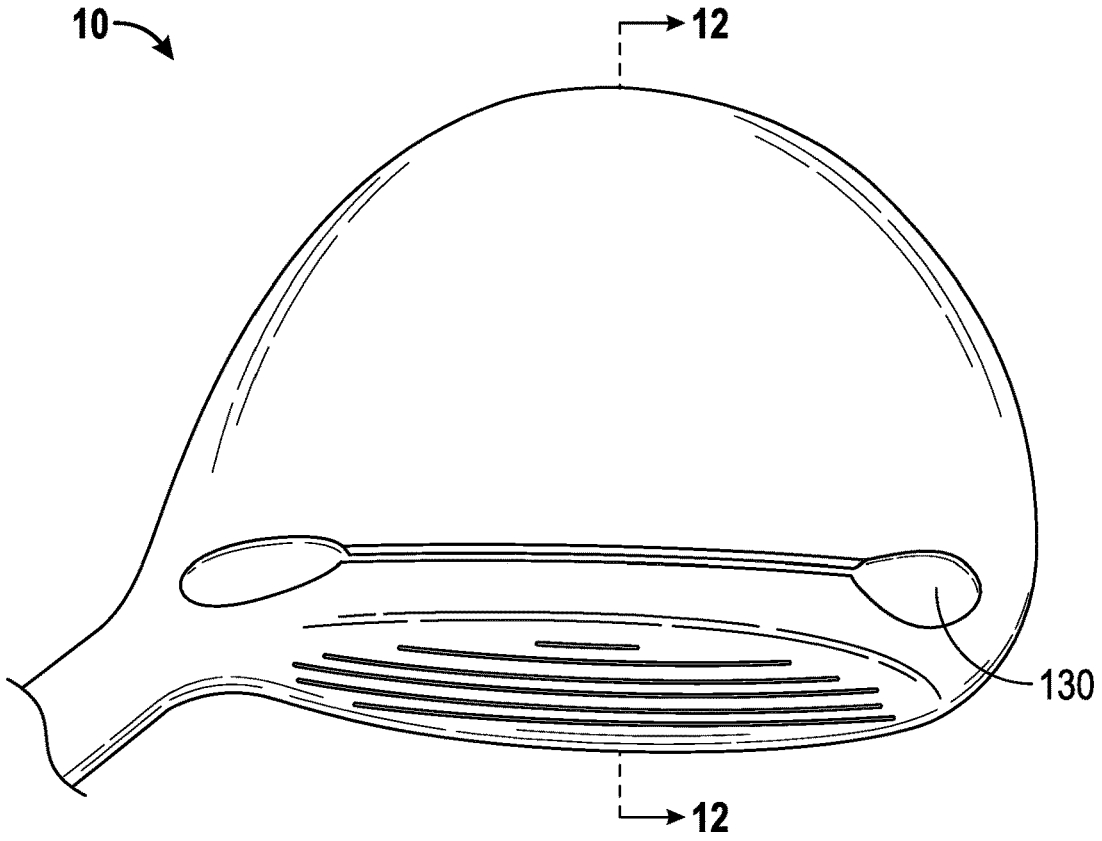
FIG. 11 is a sole, perspective view of a fourth embodiment of the present invention.
Figure 12:
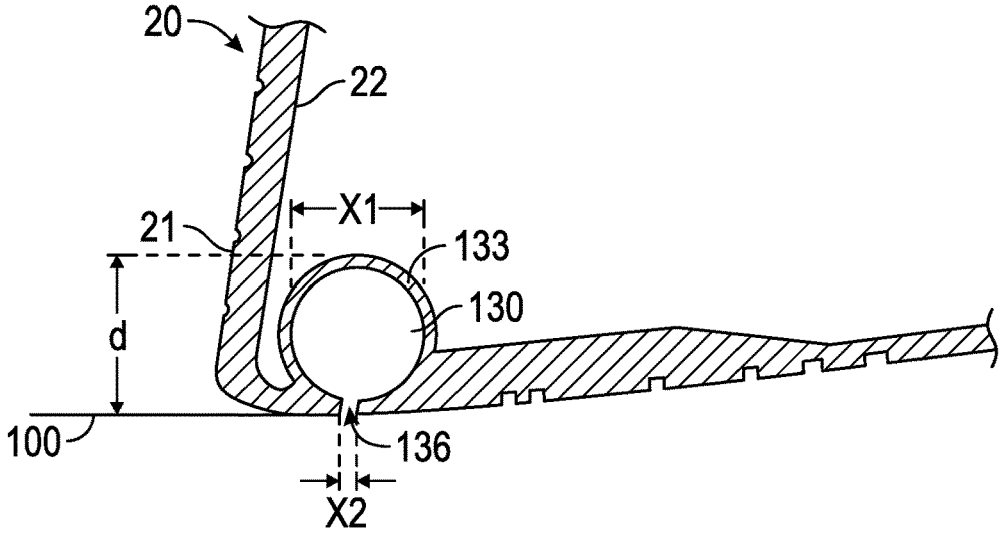
FIG. 12 is a cross-sectional view of the embodiment shown in FIG. 11 along lines 12-12.

Novel manufacturing techniques can be utilized to further optimize the surface opening of a groove, thus improving the interaction between the golf club and the turf. As shown in FIGS. 11-12, a fourth embodiment of the present invention includes a tube-shaped sole groove 130 with an opening 136 that has an even smaller width (x2) than those disclosed in FIGS. 7-10. This opening 136 preferably is integrally manufactured with the golf club head 10, but in an alternative embodiment the opening 136 can be cut into the tube-shaped groove 130 after the head 10 has been fabricated.

Figure 13:
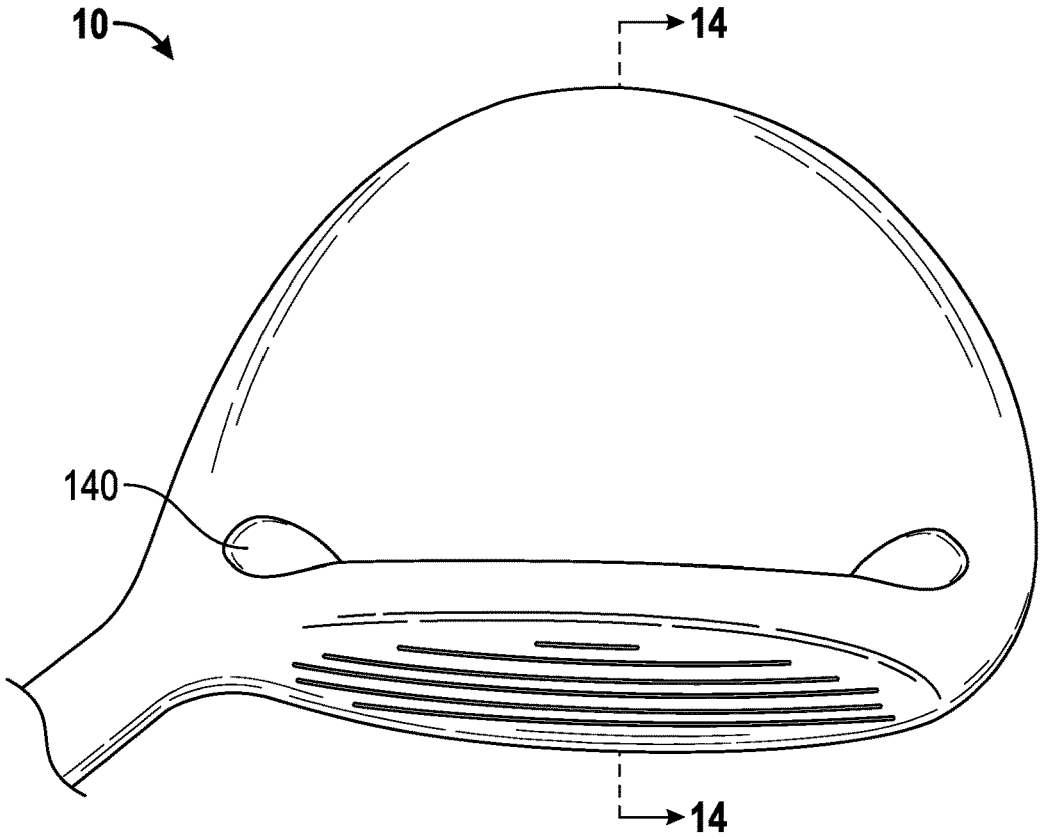
FIG. 13 is a sole, perspective view of a fifth embodiment of the present invention.
Figure 14:
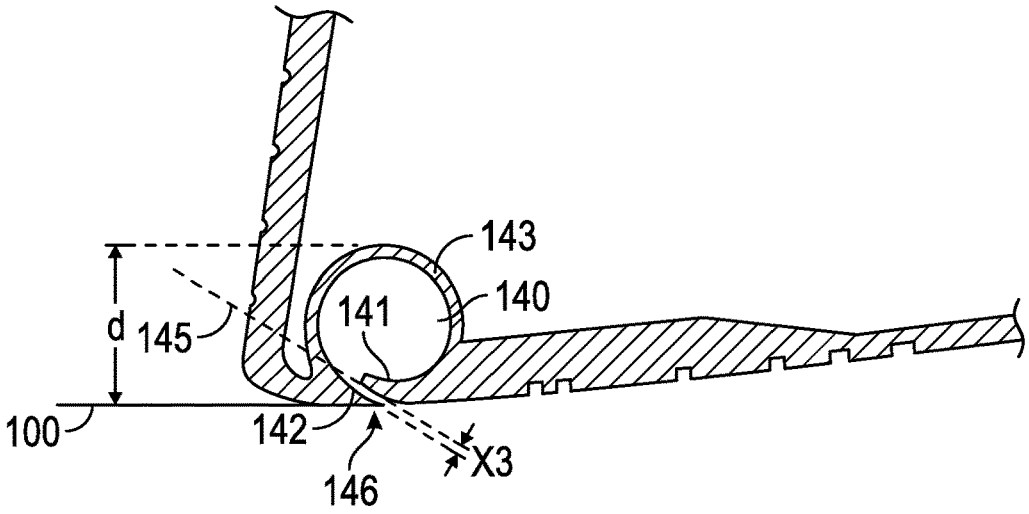
FIG. 14 is a cross-sectional view of the embodiment shown in FIG. 13 along lines 14-14.
Figure 15:
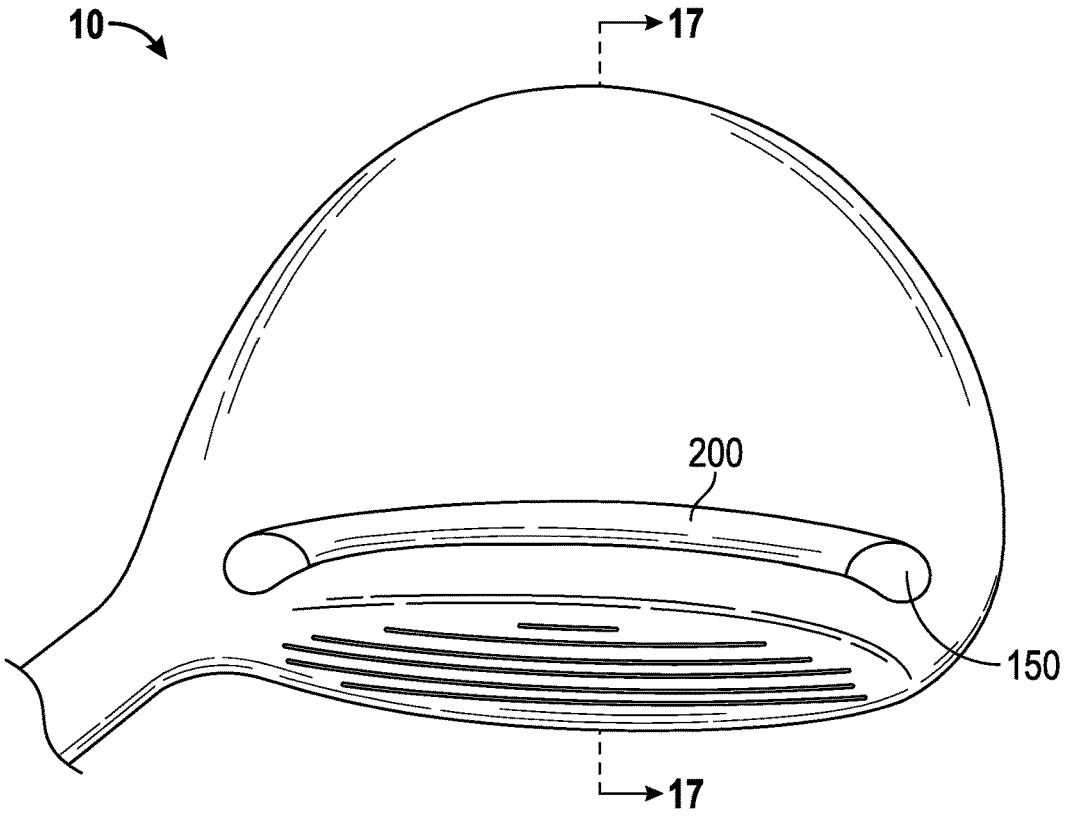
FIG. 15 is a sole, perspective view of a sixth embodiment of the present invention.
Figure 16:
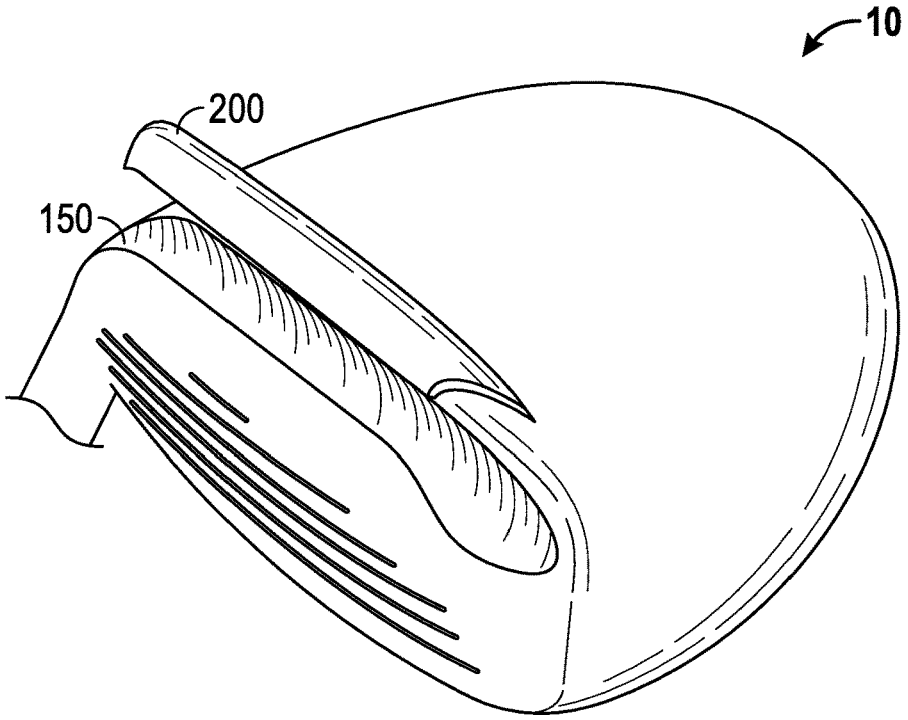
FIG. 16 is an exploded, perspective view of the embodiment shown in FIG. 15.
Figure 17:
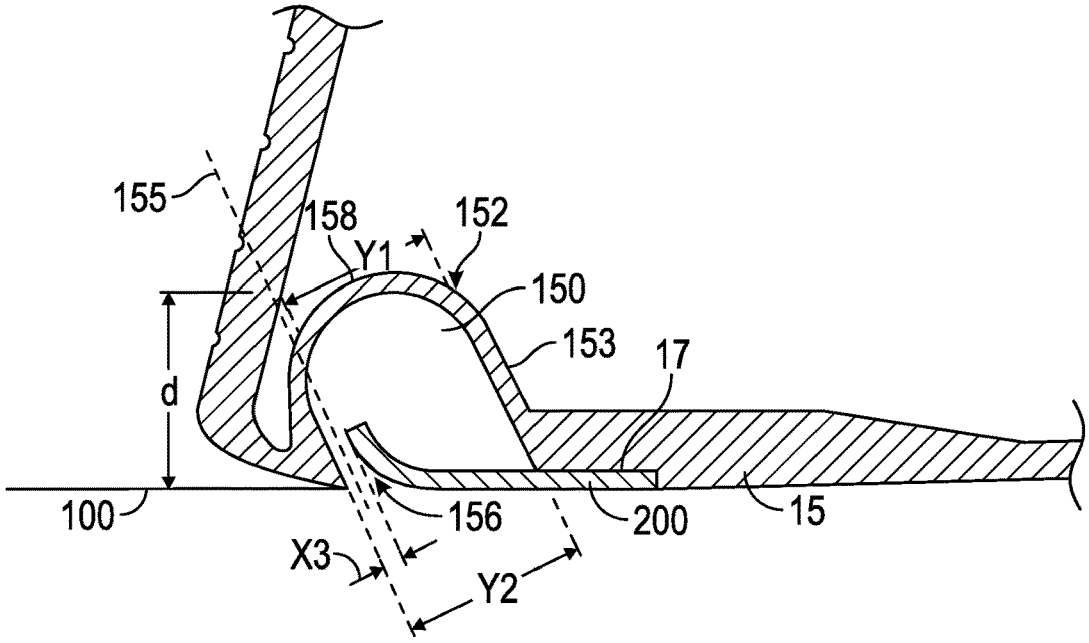
FIG. 17 is a cross-sectional view of the embodiment shown in FIG. 15 along lines 17-17.
Figure 21A:
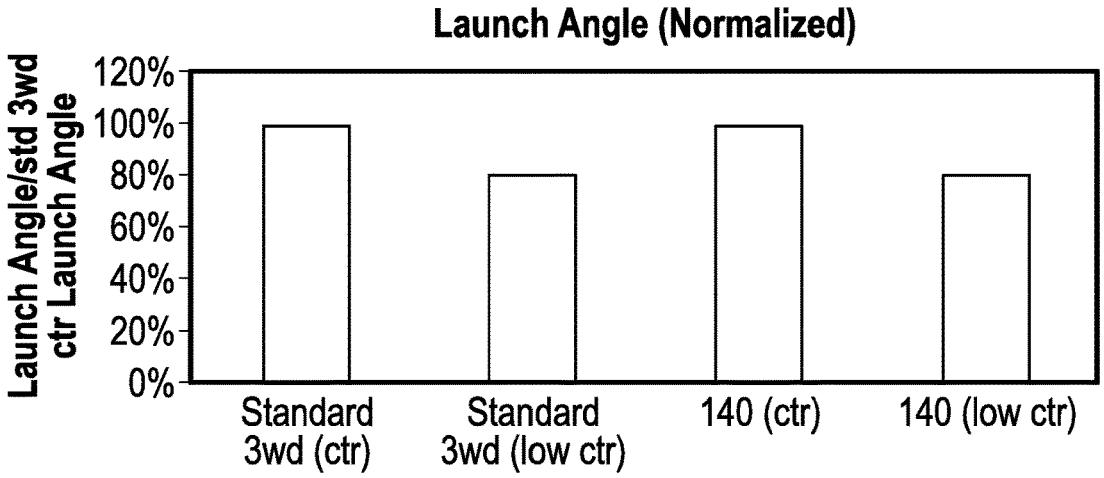
FIG. 21A is a graph comparing normalized launch angles of a standard fairway wood and a fairway wood comprising the fifth embodiment of the present invention.
Figure 21B:
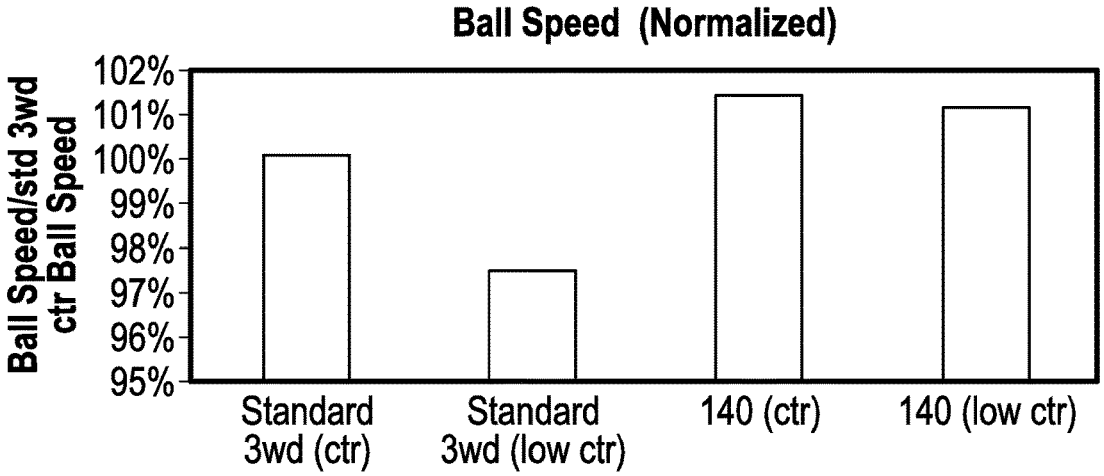
FIG. 21B is a graph comparing normalized ball speeds of a standard fairway wood and a fairway wood comprising the fifth embodiment of the present invention.
Figure 21C:
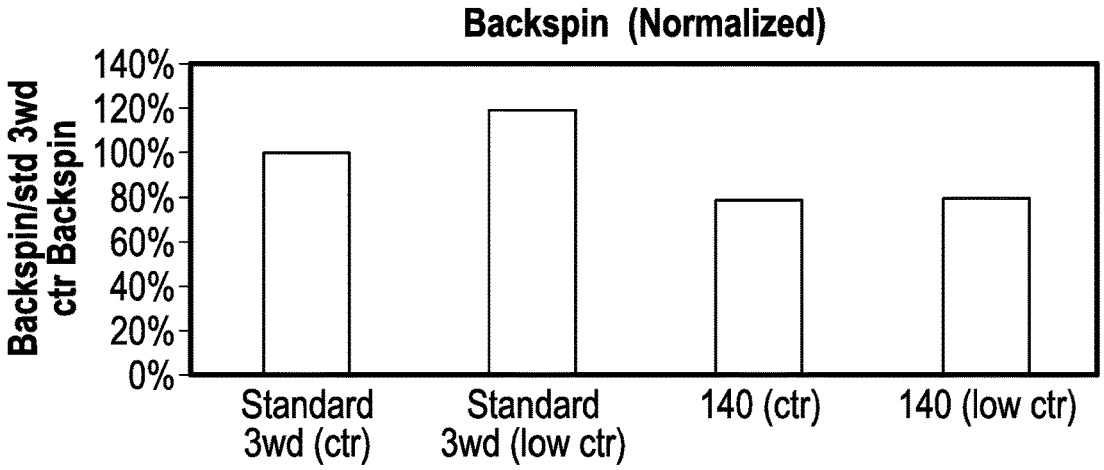
FIG. 21C is a graph comparing normalized backspin of a standard fairway wood and a fairway wood comprising the fifth embodiment of the present invention.

A fifth, preferred embodiment of the present invention, shown in FIGS. 13-14, includes a tube-shaped groove 140 with overlapping prongs 141, 142 that form an opening 146 having an axis 145 that is angled with respect to the ground plane 100 and a width (x3) that is the same as or smaller than the widths (x2) of the other sole grooves disclosed herein. The width (x3) of the opening 146 can be adjusted by moving the overlapping prongs 141, 142 of the groove 140 closer together or further apart. This groove 140 illustrates how features of the opening 146 can be adjusted without changing the overall shape of the groove 140, which in the fifth embodiment is practically identical to the tube-shaped groove 130 of the fourth embodiment. The tube shaped groove 140 shown in FIGS. 13-14 preferably is integrally formed via casting, but may be constructed from several pieces, as shown in FIGS. 16A and 16B and described herein. As shown in FIGS. 21A, 21B, and 21C, the tube-shaped groove 140 of the preferred embodiment, when incorporated into a 3-wood head, increases the ball speed of a golf ball struck at the center and low center of the golf club face, and decreases the backspin, without significantly affecting other important factors, including launch angle, that contribute to a golf ball's flight distance.

Sixth and seventh embodiments of the present invention are shown in FIGS. 15-20. These golf club heads include grooves 150, 160 with structures that are similar to the structure of the groove 140 of the preferred embodiment, in that they are tube-shaped and include openings 156, 166 with axes 155, 165 that are angled with respect to the ground plane 100, but these grooves 150, 160 are constructed from more than one piece of the golf club head 10 and thus can be formed using more traditional manufacturing processes. Specifically, the curved portion 152, 162 of these grooves 150, 160 can be formed by casting, forming, or machining the club head 10. The grooves 150, 160 are finished by affixing a sole plate or cover 200 to an exterior surface of the sole 15 to at least partially close the opening 156, 166 and alter its geometry. The sole 15 preferably has a recessed region 17 sized to receive the cover 200 so that it is flush with the surface of the sole and does not create any surface discontinuities.

Figure 18:
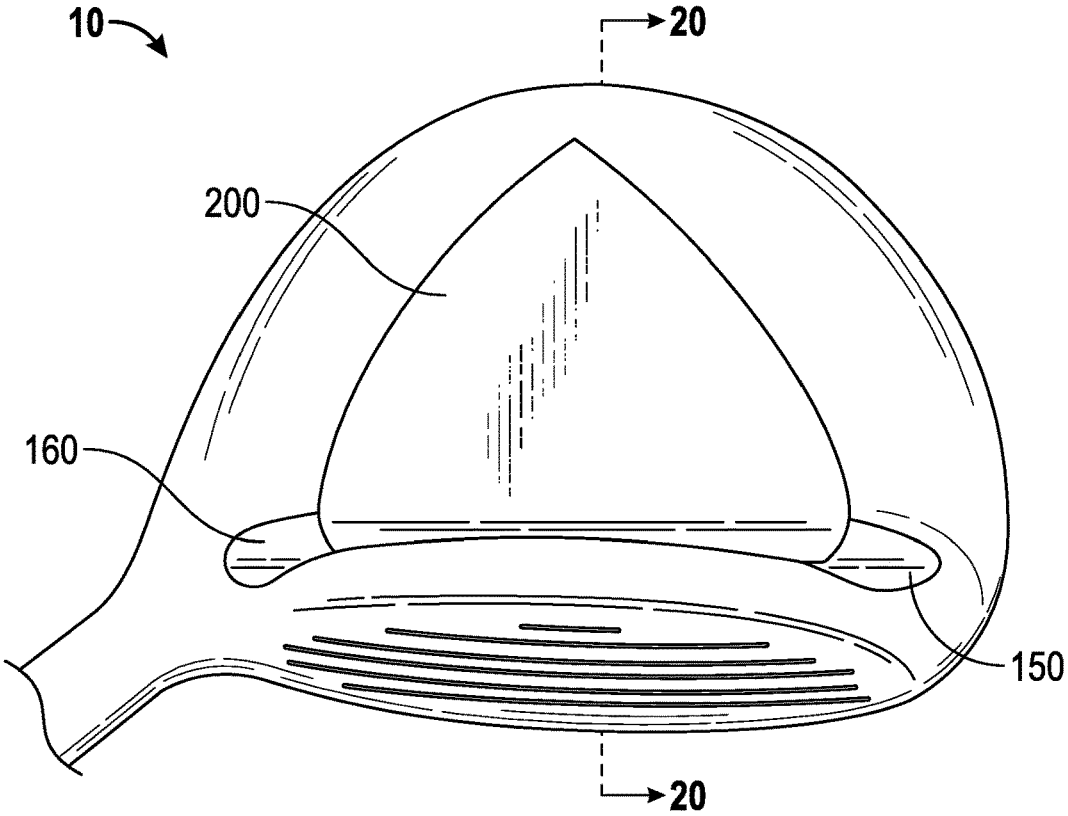
FIG. 18 is a sole, perspective view of a seventh embodiment of the present invention.
Figure 19:
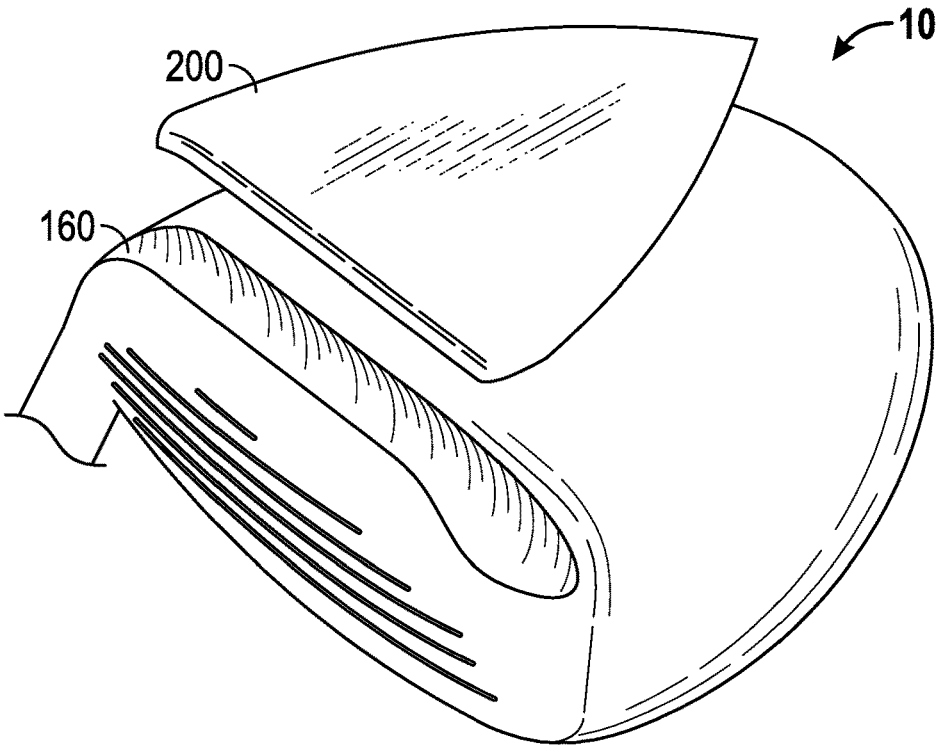
FIG. 19 is an exploded, perspective view of the embodiment shown in FIG. 18.
Figure 20:
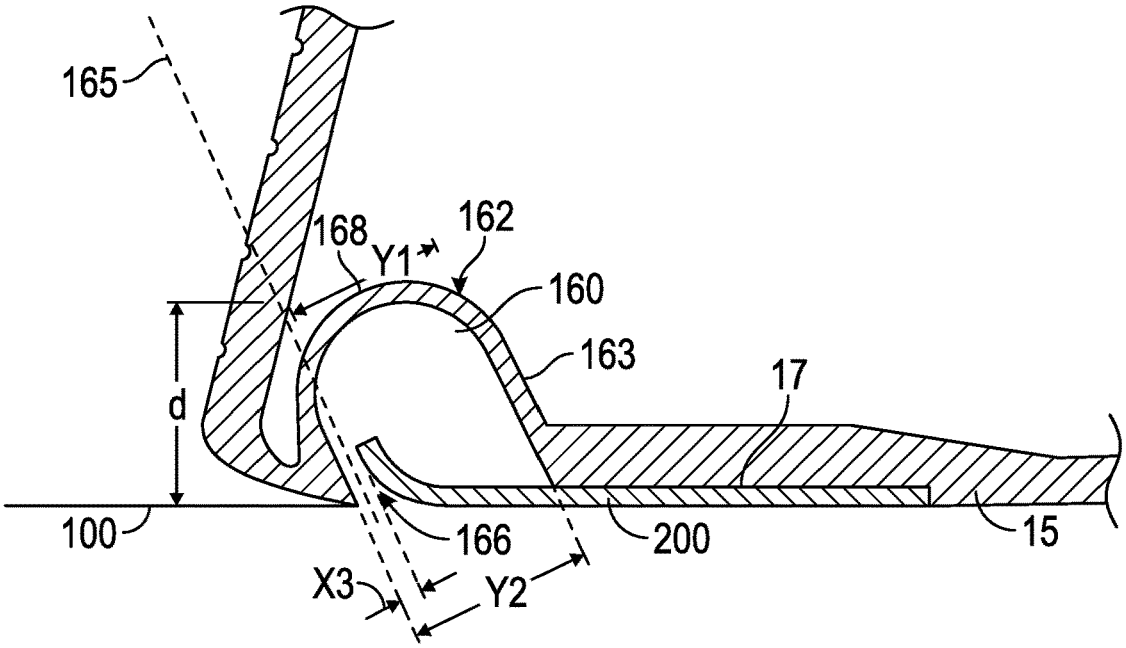
FIG. 20 is a cross-sectional view of a seventh embodiment of the present invention shown in FIG. 18 along lines 20-20.

The size, thickness, and material composition of the cover 200 preferably is selected by the manufacturer to affect the location of the club head's 10 center of gravity, the thickness of the sole 15, and the overall weight of the golf club head 10. The cover 200 may be small, as shown in FIGS. 15-17 and 22, to minimize added weight, or it may be large, as shown in FIGS. 18-20, to affect the characteristics of the golf club head 10 more significantly. The cover 200 may be affixed to the sole 15 by welding, bonding, brazing, mechanical fasteners, or a combination of these methods, which may be determined by the material used to create the cover 200. In some embodiments, the cover 200 is removably affixed to the sole 15 of the golf club head 10 to permit golfers to customize and adjust features of their golf club, including overall head weight and center of gravity location.

Figure 22:
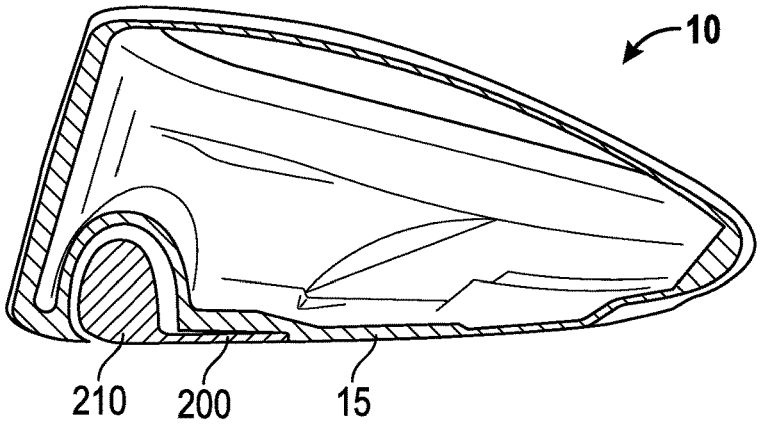
FIG. 22 is a cross-sectional view of an eighth embodiment of the present invention.

The cover 200 may also have a thickened portion 210, shown in FIG. 22, which extends into and partially or completely fills the groove 150, 160. This thickened portion 210 may be consistent across the width of the cover 200 overlapping the groove 150, 160, or may vary in thickness across the width of the cover 200. This thickened portion 210 helps to dial in the desired overall weight of the club, closes off one or both of the ends of the groove 150, 160 to prevent debris from entering the groove 150, 160, and may reduce unwanted vibration during play.

The grooves 150, 160 shown in FIGS. 15-20 represent a hybrid approach to face performance optimization because they have the novel, tube-shaped structure shown in FIGS. 11-14, and also include a feature of the prior art groove shown in FIG. 1. Specifically, the width (Y1) of these grooves' 150, 160 inward-most portion 158, 168 is approximately equivalent to the width (Y2) of the grooves' 150, 160 openings 156, 166 before they are altered by the cover 200. In alternative embodiments, the openings 156, 166 may have axes that are perpendicular to the ground plane 100 to further resemble the prior art grooves.

The embodiments shown in FIGS. 7-20 have grooves with configurations that completely decouple the groove opening size and shape from the actual groove size and shape, thus allowing both features to be optimized independently. For example, internal groove dimensions can be optimized for launch condition performance, while the groove opening can be optimized for turf interaction and increased aesthetic appeal. Specifically, the grooves 130, 140, 150, 160 of the fourth, fifth, sixth, and seventh embodiments of the invention have the following dimensions designed to optimize performance. The widths (x2, x3) of the openings 136, 146, 156, 166 are preferably between 0.010 and 1.00 inch, and more preferably between 0.030 and 0.075 inch, and most preferably approximately 0.040 inch. The openings 136, 146, 156, 166 preferably are located between 0.100 and 1 inch from the front surface 21 of the face 20, more preferably between 0.200 and 0.500 inch from the front surface 21, and most preferably approximately 0.330 inch from the front surface 21 of the face. The wall 133, 143, 153, 163 thicknesses of the grooves 130, 140, 150, 160 are preferably between 0.010 and 0.200 inch, more preferably between 0.020 and 0.075 inch, and most preferably approximately 0.030 inch.

The grooves 130, 140, 150, 160 preferably have diameters (x1, y1) of between 0.030 and 1 inch, more preferably between 0.100 and 0.500 inch, and most preferably of 0.310 inch, and a volume of between 0.100 and 1 cubic inch, more preferably between 0.200 and 0.500 cubic inch, and most preferably 0.245 cubic inch. The grooves 130, 140, 150, 160 preferably are located proximate an inner surface 22 of the golf club face 20, preferably between 0.005 and 1 inch, more preferably between 0.010 and 0.050 inch, and most preferably approximately 0.030 inch, and are preferably located between 0.010 and 1 inch from a front surface 21 of the face 20, more preferably between 0.100 and 0.500 inch from the front surface 21, and most preferably approximately 0.150 inch from the front surface 21.

Figure 23A:
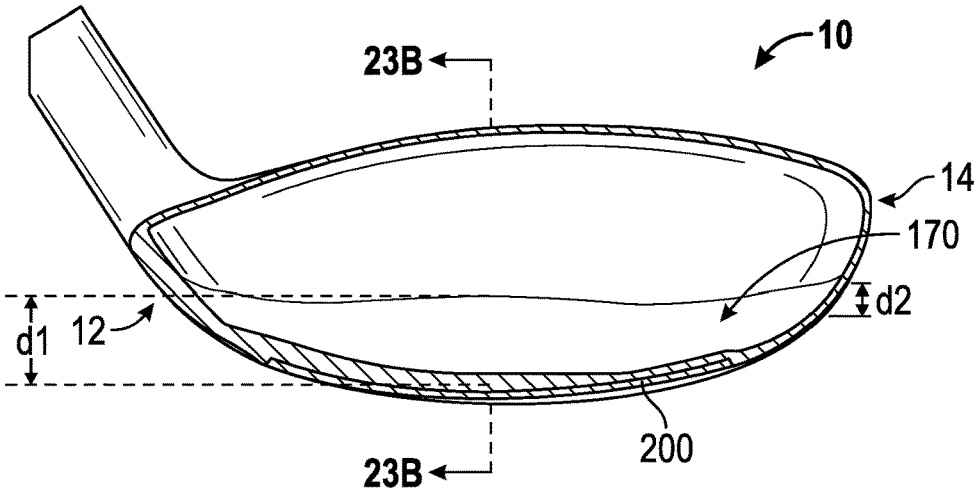
FIG. 23A is a cross-sectional view of a ninth embodiment of the present invention.
Figure 23B:
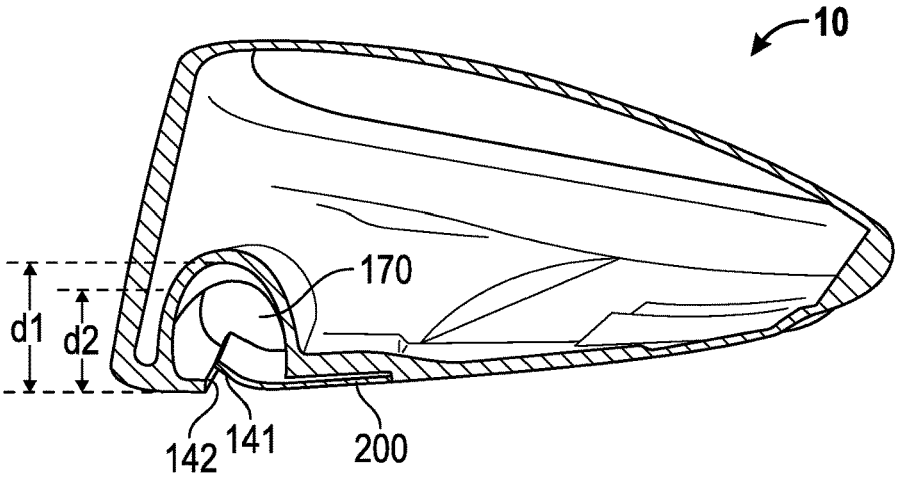
FIG. 23B is another cross-sectional view of the embodiment shown in FIG. 23A along lines 23B-23B.

The grooves 130, 140, 150, 160 also preferably have a depth (d) from the innermost point of the groove 130, 140, 150, 160 to the ground plane 100 of between 0.010 inch and 1 inch, more preferably between 0.100 and 0.500 inch, and most preferably 0.410 inch. In some embodiments, the depth (d) and/or shape of the groove 130, 140, 150, 160 may change as the groove extends across the sole 15 of the club head 10. For example, in the embodiment shown in FIGS. 23A and 23B, the depth of the groove 170 varies as it extends from the heel side 12 of the club head 10 to the toe side 14. In this embodiment, the greatest depth $d_1$ is preferably disposed at a central point between the heel 12 and the toe 14 and the smallest depth $d_2$ is preferably disposed proximate the toe 14, though the location of the greatest and smallest depths may be adjusted as needed to achieve optimized hitting characteristics. If this embodiment is combined with the cover 200 shown in FIG. 22, the thickened portion 210 may vary in thickness to match the variable depth of the groove 170. In alternative embodiments, the grooves of the present invention may have other variable dimensions, such as width, shape, and/or wall thickness instead of, or in addition to, variable depth.

In each of the embodiments disclosed herein, the grooves may be a secondary piece that is inserted into and bonded to the body of the club head. This type of construction allows for easier manufacture of the inventive groove, more complex groove shapes, and the use of multiple materials to form the head and groove combination. The use of different materials allows for greater freedom in designing the mass properties of the golf club head 10, and also in designing the functionality of the slot by changing material stiffness, strength, and allowing for different manufacturing techniques, which may include different types of geometric constraints (e.g., undercuts, draft angles, etc.).

Figure 24A:
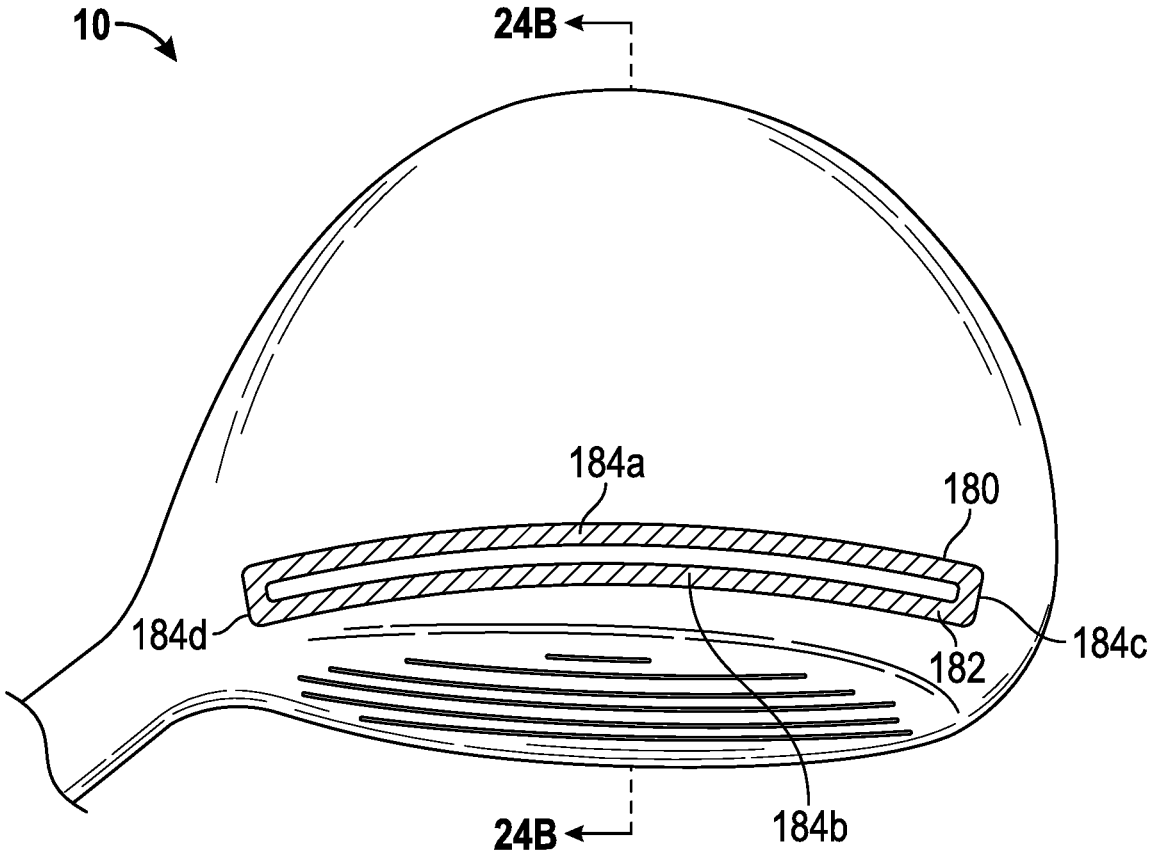
FIG. 24A is a sole perspective view of a tenth embodiment of the present invention.
Figure 24B:
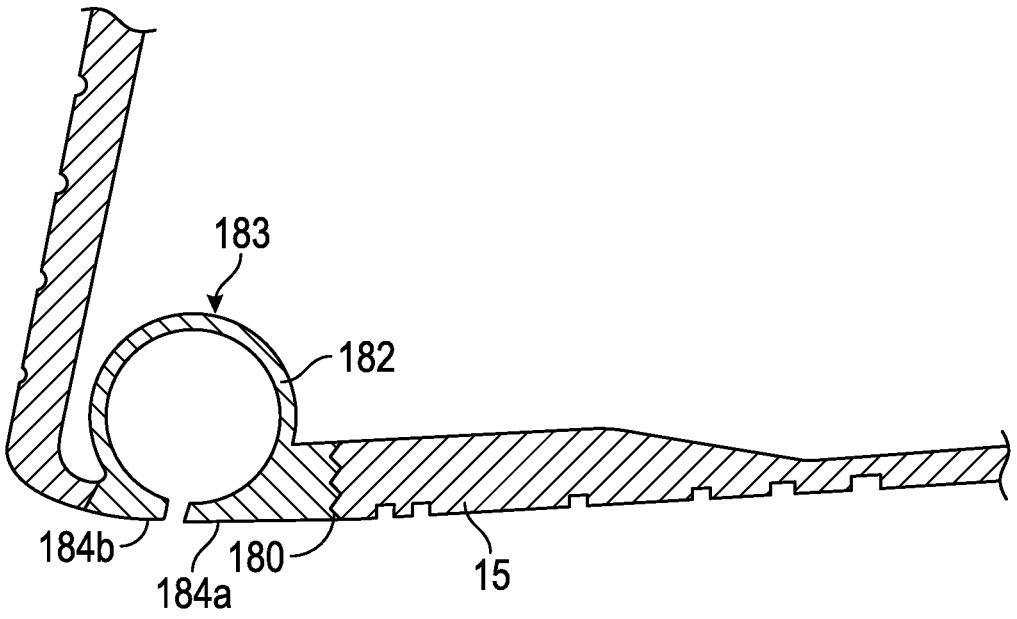
FIG. 24B is a cross-sectional view of the embodiment shown in FIG. 24A along lines 24B-24B.

For example, as shown in FIGS. 24A and 24B, the golf club head 10 comprises a sole opening 180 sized to receive a groove insert 182, which in this embodiment comprises the dimensions of the groove 130 shown in FIG. 12 but, in alternative embodiments, may comprise any of the structures or dimensions of other grooves disclosed herein. The groove insert 182 may also, in other embodiments, be inserted into other parts of the golf club head 10. This configuration is beneficial because it allows the groove 182 to be formed from a material that differs from that of the golf club head 10, and thus provide different weighting and performance qualities, which may be related to strength, elastic modulus (stiffness), and manufacturing techniques and constraints available for the material used to make the groove insert 182.

In the embodiment shown in FIGS. 24A and 24B, the groove insert 182 has a tube-shaped portion 183 and four flat end portions 184*a*, 184*b*, 184*c*, 184*d* that are coplanar with the sole 15. In alternative embodiments, the groove insert 182 may also have a portion that overlaps with the sole opening to provide additional bond surface area or to allow for space for through holes for mechanical fasteners. The groove insert 182 preferably is composed of a metal alloy and is welded to the sole 15 at the flat end portions 184*a*, 184*b*, 184*c*, 184*d* after being inserted into the sole opening 180. In alternative embodiments, the sole insert 182 may be soldered, bonded, brazed, or mechanically secured within the sole opening 180.

Figure 25A:
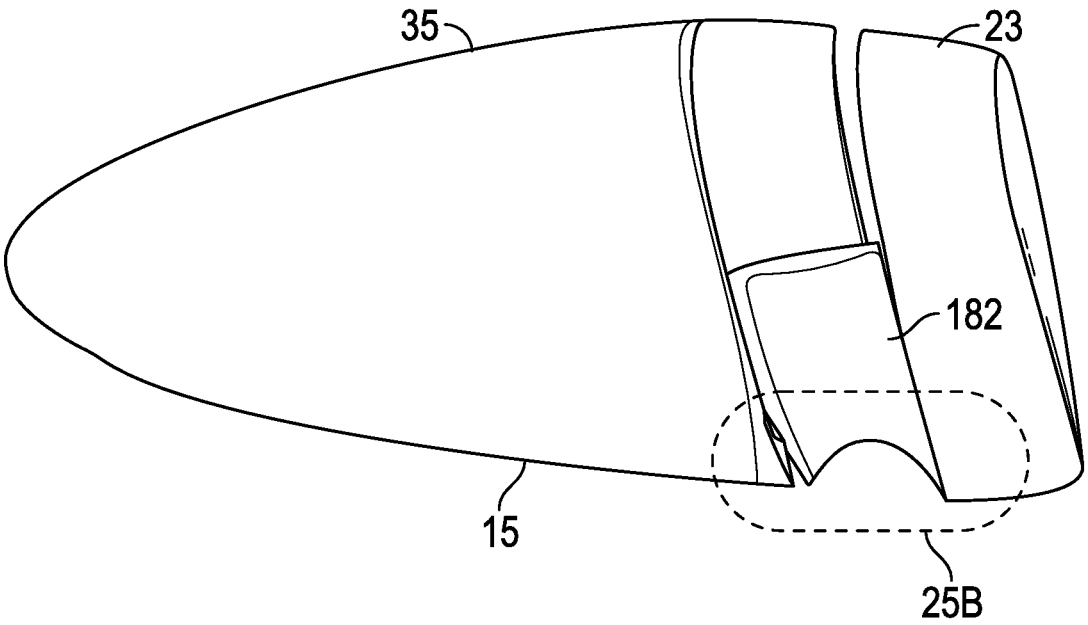
FIG. 25A is an exploded, perspective view of an eleventh embodiment of the present invention.
Figure 25B:
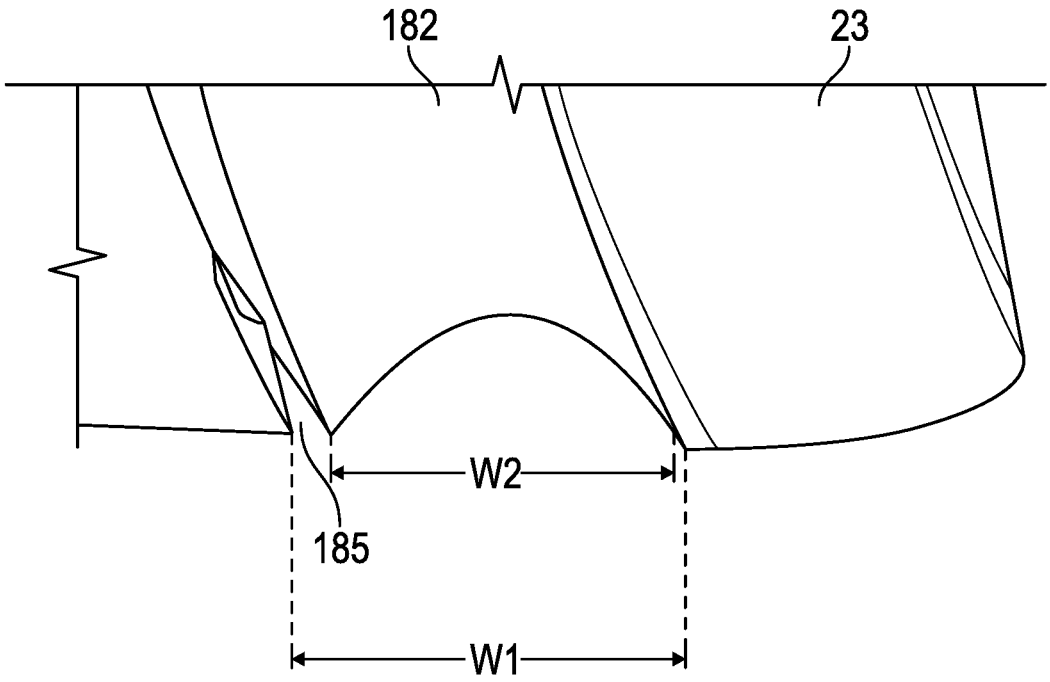
FIG. 25B is a close up view of the circled region in FIG. 25A.
Figure 25C:
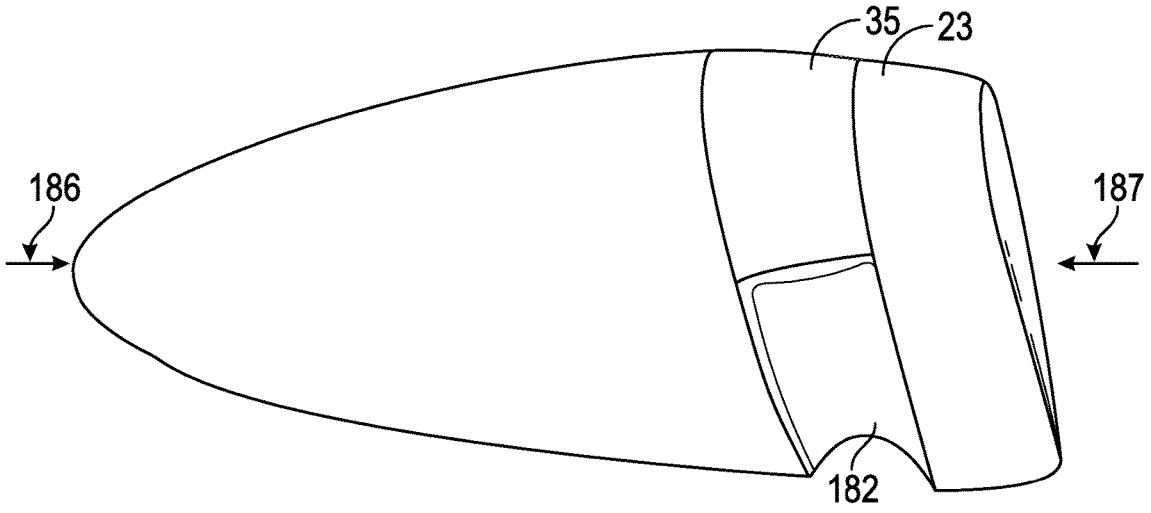
FIG. 25C is a side perspective, assembled view of the embodiment shown in FIG. 25A, with force lines indicating pressure exerted on the face cup and body of the embodiment.
Figure 25D:
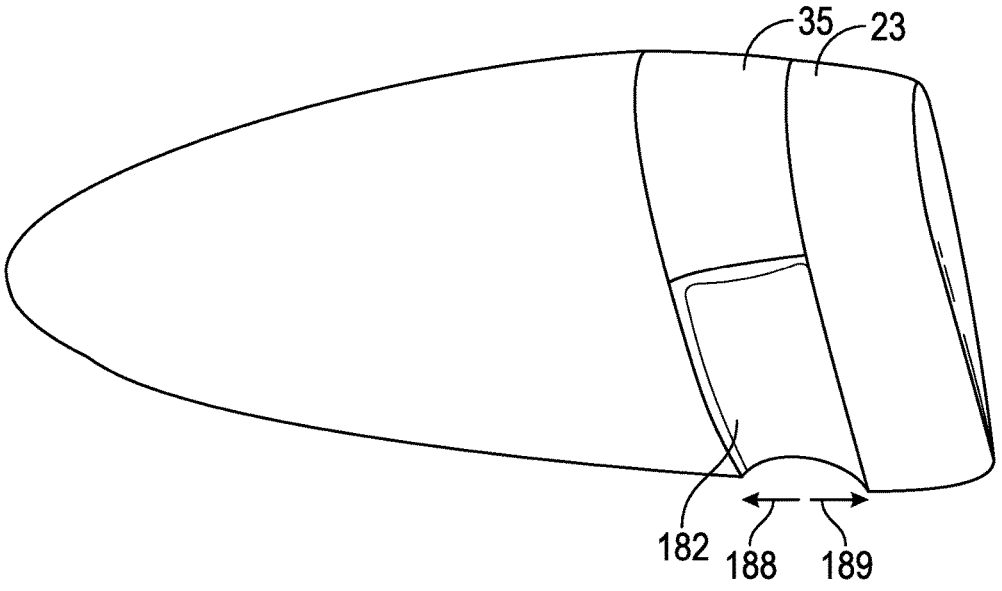
FIG. 25D is another side perspective, assembled view of the embodiment shown in FIG. 25A, with force lines indicating the stress on the groove insert.

In a further embodiment, the sole insert 182 may be preloaded within the head to give the face additional compliance. In particular, the use of a preloaded sole insert 182 redistributes the stress in the head so that the groove and the face can deflect a greater distance without reaching the yield stress of the materials used to construct the inventive golf club head 10. As shown in FIGS. 25A and 25B, the golf club head 10 may be formed from two separate pieces, a face cup 23 and a body 35 comprising a cutout or opening 185 in the sole 15 and extending into the heel 12 and toe 14. As shown in these Figures, the sole insert 182 has a width W2 that is smaller than the width W1 of the opening 185. When the face cup 23 is being welded or otherwise affixed to the body 35, both pieces are secured within a device (not shown) to press them closely together for the attachment process. The compression forces exerted on the face cup 23 and body 35 are indicated with force lines 186, 187. In this configuration, shown in FIG. 25C, the sole insert 182 completely fills the opening 185 and, while in this uncompressed state, it is bonded or otherwise affixed to the sides of the opening 185. Once attachment of the face cup 23 to the body 35 is complete, and the device is removed, the resulting golf club head 10 is allowed to expand, thus stretching the sole insert 182 out of its uncompressed state as shown in FIG. 25D and providing additional compliance to the face. The stress on the sole insert 182 is shown in FIG. 25D with force lines 188, 189.

Figure 26A:
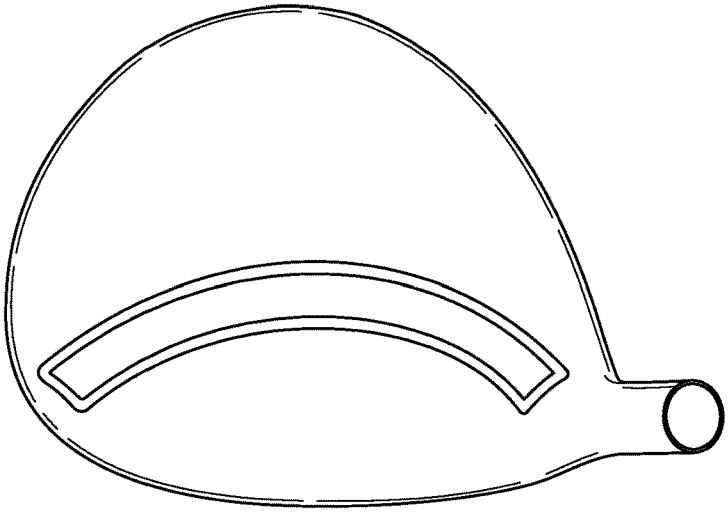
FIGS. 26A, 26B, and 26C are top perspective views of twelfth, thirteenth, and fourteenth embodiments of the present invention.
Figure 26B:
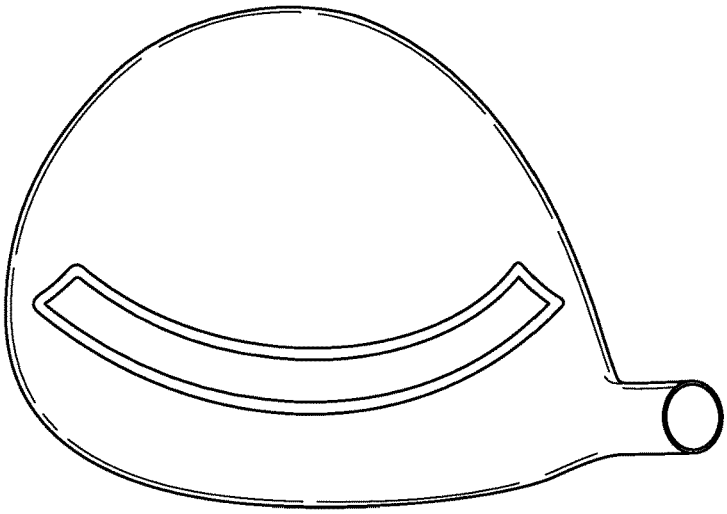
Figure 26C:
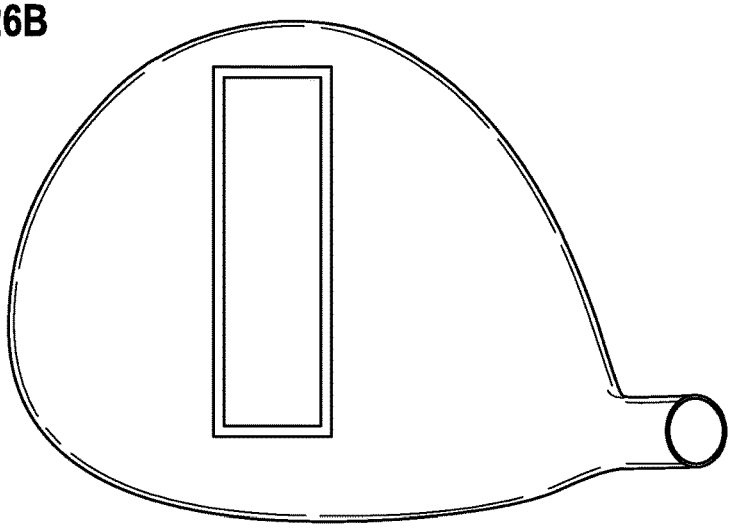

A golf club head incorporating one or more grooves 130, 140, 150, 160 of the present invention preferably has a sole 15 thickness of 0.030 to 0.50 inch, more preferably 0.040 to 0.100 inch, and most preferably 0.060 inch. The sole grooves described herein can be used with any type of golf club head, but are preferably used with wood and hybrid-type clubs, and most preferably with fairway woods. Each of the grooves described herein may extend partially or completely across the golf club sole, and preferably extend in a toe-heel direction proximate the face. In alternative embodiments, the grooves described herein may be disposed on regions of the golf club head 10 other than the sole. For example, the grooves may extend along the heel and toe sides of the golf club head, or across the crown, as disclosed in U.S. Patent Application Publication Number 2011/0218053, the disclosure of which is hereby incorporated by reference in its entirety herein. The grooves may curve as they extend across surfaces of the club, and thus be disposed at varying distances from the face, as shown in FIGS. 26A and 26B, or extend perpendicular to the face, as shown in FIG. 26C. The shape and structure of the grooves disclosed herein may be tuned by the manufacturer to achieve improved sound and feel.

Figure 27A:
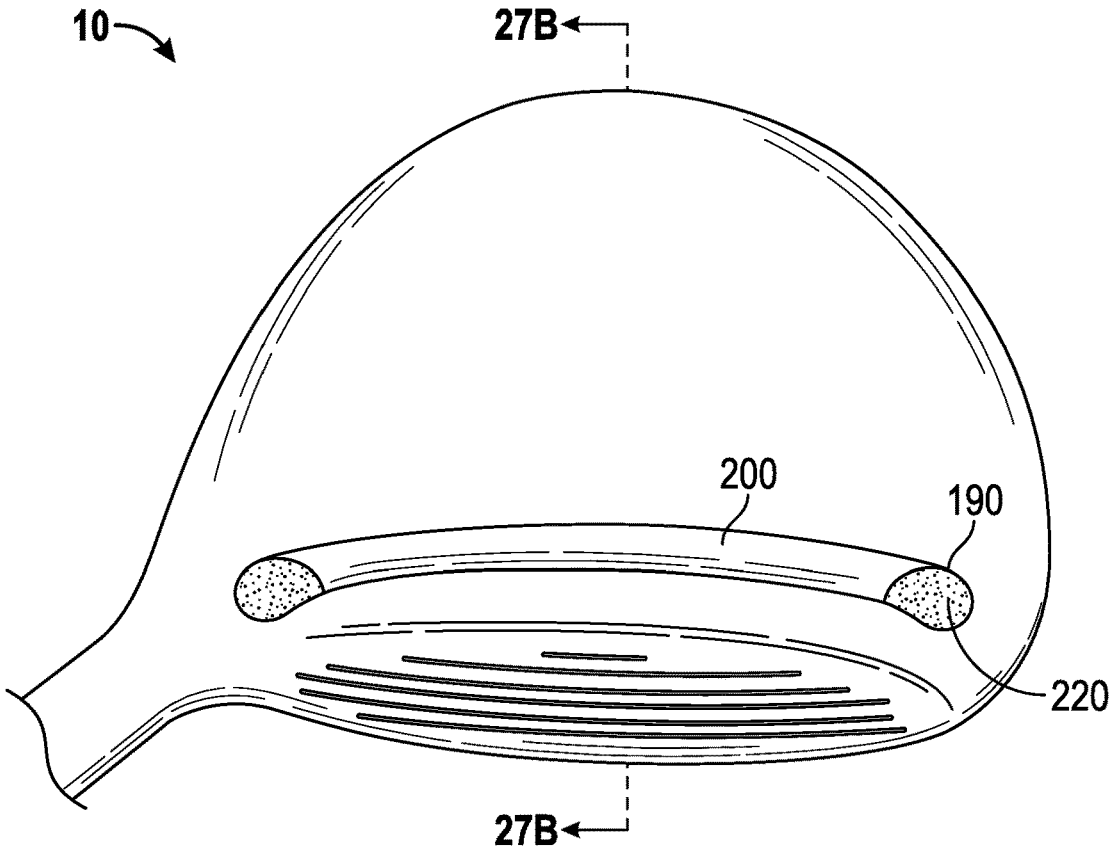
FIG. 27A is a sole perspective view of a fifteenth embodiment of the present invention.
Figure 27B:
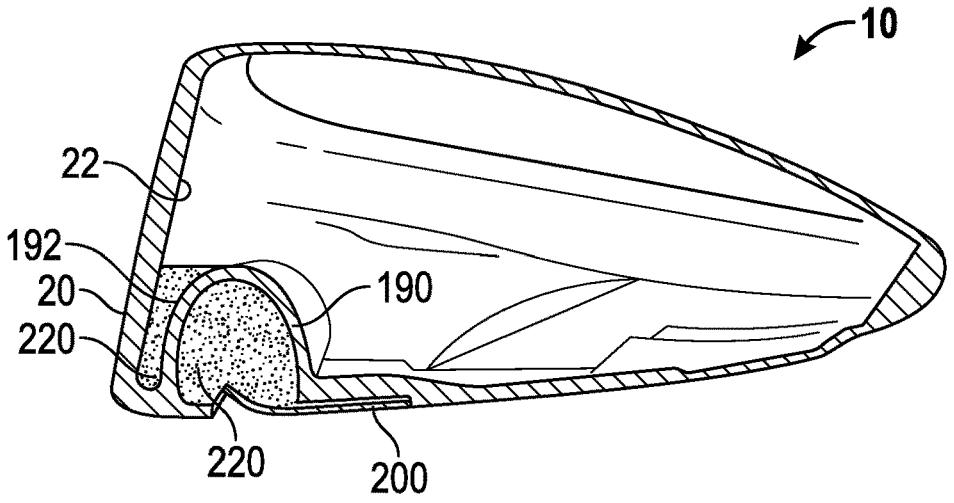
FIG. 27B is a cross sectional view of the embodiment shown FIG. 27A along lines 27B-27B.

In some embodiments, an example of which is shown in FIG. 27A, the grooves described herein may be partially or completely filled with a soft, low density material 220 that closes off the ends or open portions of the grooves to prevent debris from entering them and reduces unwanted vibration during play. The composition of the filler material can be selected to suit the needs of an individual golfer. For example, a player with a faster swing speed may select a stiffer filler material than a golfer with a lower swing speed. Materials with different densities, stiffness, and damping properties can also be used to adjust center of gravity location, head weight, moment of inertia, sound, and feel of the golf club head. The filler material 220 may also be disposed between an internal surface 192 of the groove 190 and an inner surface 22 of the club face 20, as shown in FIG. 27B, to provide additional face compliance. The filler material 220 in this embodiment may be compressed between these two surfaces 22, 192.

The golf club heads disclosed herein may have any volume, shape, or proportions and can be formed from one or more materials, including those material compositions disclosed in U.S. Pat. Nos. 6,244,976, 6,332,847, 6,386,990, 6,406,378, 6,440,008, 6,471,604, 6,491,592, 6,527,650, 6,565,452, 6,575,845, 6,478,692, 6,582,323, 6,508,978, 6,592,466, 6,602,149, 6,607,452, 6,612,398, 6,663,504, 6,669,578, 6,739,982, 6,758,763, 6,860,824, 6,994,637, 7,025,692, 7,070,517, 7,112,148, 7,118,493, 7,121,957, 7,125,344, 7,128,661, 7,163,470, 7,226,366, 7,252,600, 7,258,631, 7,314,418, 7,320,646, 7,387,577, 7,396,296, 7,402,112, 7,407,448, 7,413,520, 7,431,667, 7,438,647, 7,455,598, 7,476,161, 7,491,134, 7,497,787, 7,549,935, 7,578,751, 7,717,807, 7,749,096, and 7,749,097, the disclosure of each of which is hereby incorporated in its entirety herein.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. A wood-type golf club head comprising:

a metal face having a front surface and an inner surface;

a crown;

a metal sole comprising a first elongated groove and a second elongated groove;

an interior cavity; and a low-density filler material disposed within the interior cavity between the inner surface of the face and a front wall of the first elongated groove, wherein each of the face and the sole is composed of a metal alloy material, wherein the sole has a thickness of 0.030 to 0.50 inch, wherein the first groove comprises a first groove opening disposed proximate to the face and extending in a toe-to-heel direction, at least one negative draft wall, and a depth that varies as the groove extends from a heel side to a toe side, wherein the first groove opening comprises a toe-side portion having a first front-to-back width, a heel-side portion having a second front-to-back width, and a central portion having a third front-to-back width connecting the toe-side portion to the heel-side portion, wherein the first groove opening is spaced 0.100 inch to 1.00 inch away from the front surface of the face, wherein the first groove has a wall thickness of between 0.010 inch and 0.200 inch, and wherein the second groove extends approximately perpendicular to the face.

2. The wood-type golf club head of claim 1, wherein the first and second front-to-back widths are greater than the third front-to-back width.

3. The wood-type golf club head of claim 1, wherein the sole has a thickness of 0.040 to 0.100 inch.

4. The wood-type golf club head of claim 3, wherein the sole has a thickness of 0.060 inch.

5. The wood-type golf club head of claim 1, wherein the first, second, and third front-to-back widths are between 0.010 and 1.00 inch.

6. The wood-type golf club head of claim 1, wherein the first groove comprises a volume of between 0.100 cubic inch and 1.00 cubic inch.

7. The wood-type golf club head of claim 1, wherein each of the first and the second grooves is spaced between 0.005 inch and 1.00 inch from an inner surface of the face.

8. The wood-type golf club head of claim 7, wherein the first groove is spaced between 0.010 inch and 0.050 inch from an inner surface of the face.

9. The wood-type golf club head of claim 1, wherein the first groove has a greatest depth at a central point between the heel side and the toe side.

10. The wood-type golf club head of claim 1, wherein the first groove has a smallest depth at a point proximate the toe side.

11. The wood-type golf club head of claim 1, wherein the low-density filler material is a polymer.

12. The wood-type golf club head of claim 1, wherein the first groove increases the ball speed, and decreases backspin, of a golf ball struck at a low and center area of the face.

13. The wood-type golf club head of claim 1, wherein the first groove opening is spaced 0.200 inch to 0.500 inch away from the front surface of the face.

14. The wood-type golf club head of claim 13, wherein the first groove opening is spaced approximately 0.330 inch away from the front surface of the face.

15. The wood-type golf club head of claim 1, wherein the first groove opening comprises an axis that is angled with respect to a ground plane.

* * * * *